US010993050B2

(12) United States Patent
Liou

(10) Patent No.: US 10,993,050 B2
(45) Date of Patent: Apr. 27, 2021

(54) JOINT SPECTRAL GAIN ADAPTATION MODULE AND METHOD THEREOF, AUDIO PROCESSING SYSTEM AND IMPLEMENTATION METHOD THEREOF

(71) Applicant: INVICTUMTECH INC., Diamond Bar, CA (US)

(72) Inventor: Ming-Luen Liou, Taipei (TW)

(73) Assignee: INVICTUMTECH INC, Diamond Bar, CA (US)

( * ) Notice: Subject to any disclaimer, the term of this patent is extended or adjusted under 35 U.S.C. 154(b) by 0 days.

(21) Appl. No.: 16/399,398

(22) Filed: Apr. 30, 2019

(65) Prior Publication Data

US 2020/0145764 A1 May 7, 2020

(30) Foreign Application Priority Data

Nov. 2, 2018 (TW) ..... 107139003 A

(51) Int. Cl.
*H04R 25/00* (2006.01)

(52) U.S. Cl.
CPC ..... *H04R 25/505* (2013.01); *H04R 2225/43* (2013.01)

(58) Field of Classification Search
CPC .. H04R 25/505; H04R 25/70; H04R 2225/39; H04R 2225/41; H04R 2225/43; H04R 2460/01
See application file for complete search history.

(56) References Cited

U.S. PATENT DOCUMENTS

| | | | | |
|---|---|---|---|---|
| 7,328,151 | B2 * | 2/2008 | Muesch | G10L 21/0364 381/312 |
| 7,617,000 | B2 * | 11/2009 | Franck | A61N 1/08 600/25 |
| 8,675,900 | B2 * | 3/2014 | Anderson | A61B 5/121 381/314 |
| 8,792,659 | B2 * | 7/2014 | Ypma | H04R 25/552 381/312 |
| 9,155,886 | B2 * | 10/2015 | James | A61N 1/37247 |
| 9,414,173 | B1 * | 8/2016 | Hou | H04R 25/70 |
| 9,735,746 | B2 * | 8/2017 | Christoph | H03G 3/20 |
| 2017/0366904 | A1 * | 12/2017 | Oetting | H04R 25/552 |
| 2018/0115839 | A1 * | 4/2018 | Eichfeld | G10K 11/17861 |
| 2019/0082278 | A1 * | 3/2019 | Boley | H04R 25/50 |

* cited by examiner

*Primary Examiner* — Ryan Robinson
(74) *Attorney, Agent, or Firm* — Elizabeth Yang

(57) ABSTRACT

A joint spectral gain adaption module, which comprises: an aided-ear loudness model, wherein an aided-ear loudness spectrum is obtained by performing computations on an aided-ear threshold elevation profile and a spectrum selected from the group consisting of an input spectrum and a first spectrum derived from the input spectrum; a bare-ear loudness model, wherein a bare-ear loudness spectrum is obtained by performing computations on a bare-ear threshold elevation profile, and a modified spectrum previously obtained; and a spectrum shaping sub-module, wherein the modified spectrum previously obtained is passed to the bare-ear loudness model as an input, and a modified spectrum and a linear spectral gain vector are obtained by performing computations on the input spectrum, the bare-ear loudness spectrum, and a loudness spectrum selected from the group consisting of the aided-ear loudness spectrum and a first loudness spectrum derived from the aided-ear loudness spectrum.

20 Claims, 11 Drawing Sheets

JOINT SPECTRAL GAIN ADAPTATION MODULE AND METHOD THEREOF, AUDIO PROCESSING SYSTEM AND IMPLEMENTATION METHOD THEREOF

TECHNICAL FIELD

The present invention relates to the field of sound signal processing, and particularly relates to a joint spectrum gain adaptation module and method thereof, an audio processing system and an implementation method thereof.

BACKGROUND

Current digital audio processing systems perform signal processing on digitized sounds. FIG. 1 shows the example of the frequency-domain audio processing system architecture employing the analysis-modification-synthesis (hereinafter abbreviated as AMS) framework, wherein an analog-to-digital conversion (hereinafter abbreviated as ADC) unit 110 is used to convert an analog input (hereinafter abbreviated as AI) signal into a digital input (hereinafter abbreviated as DI) signal, a framing and waveform analysis (hereinafter abbreviated as FWA) unit 120 is used to segment and transform the DI signal into a plurality of input spectra (in the present invention, a spectrum is a vector representation of the amplitude or the phase of each frequency component of a sound), a spectrum modification module 130 is used to process each input spectrum to obtain a corresponding modified spectrum, and a waveform synthesis unit 140 is used to perform waveform synthesis on the modified spectra to obtain a digital output (hereinafter abbreviated as DO) signal, thereafter, a digital-to-analog conversion (hereinafter abbreviated as DAC) unit 150 is used to convert the DO signal into an analog output (hereinafter abbreviated as AO) signal. The detailed description of waveform analysis and synthesis operations can be referred to reference documents 1, 2.

The spectrum modification module 130 of FIG. 2 integrates multiple audio processing modules according to the system requirements. Taking the implementation of a hearing assistive function as an example, it includes a noise reduction (hereinafter abbreviated as NR) module 160 and a dynamic range compression (hereinafter abbreviated as DRC) module 180. Some designs further include a spectral contrast enhancement (hereinafter abbreviated as SCE) module 170 for speech enhancement purpose. These three types of processing achieve their design goals by providing a gain or attenuation to the sound components at each frequency. The NR module 160 is used to suppress noise or interference components that with statistical characteristics difference from that of the speech to reduce the impact of the noise on the listener. For its principle and embodiments, refer to reference document 2. If the perceptual based NR processing is employed, the listener's auditory information such as the hearing threshold at each frequency in FIG. 2 is required (in the present invention, a hearing threshold means the lowest perceptible sound level of the listener's single ear at a specified frequency in a quiet background, and the hearing threshold of a listener's ear is represented as a vector that contains the hearing thresholds corresponding to a set of frequencies in the audio frequency range).

The SCE module 170 is used to enhance the contrast between peaks and valleys of the global or local power spectrum to make it easier for listeners to obtain clues to identify speech and music. For its principle and design examples, refer to reference document 3. Yet over-enhancing spectral contrast leads to strong noise amplification that affects listening adversely. Appropriately enhancing the spectral contrast is the key to help listeners.

In conventional audio processing, the DRC module 180 is used to adjust the level and transient behavior of the input sound at each channel to modify the sound volume and the sound quality.

Referring to reference document 4, the DRC processing in hearing aids and related applications is aimed to reduce the dynamic range of the input sound at each channel, so that the result sound conforms to the reduced auditory dynamic range of the impaired ear, that is, the sound pressure level between the listener's hearing threshold to the discomfort level at each frequency, thereby mitigating the hearing loss. In FIG. 2, a fitting procedure 190 is used to determine the compression characteristics of each channel (represented by a static mapping function of input sound level to output sound level or input sound level to channel gain) according to the hearing threshold of the listener at each frequency. The DRC module 180 then employs the compression characteristic of each channel to provide hearing assistance to the listener appropriately. Likewise, the fitting procedure in the present invention is used to determine the hearing-related setting of the audio processing modules, and the concept and operations of the fitting procedure can be referred to the prescription procedure in reference document 4.

Performing DRC processing with static mapping functions, however, does not take into account the auditory masking which is the sound perception being weakened or inhibited by temporally or spectrally adjacent sounds. This effect may not be significant for normal hearing (hereinafter abbreviated as NH) listeners. As the auditory masking getting worse with the increased hearing loss (i.e. the perception get stronger influence by sounds within a wider spectral and temporal region), listeners cannot perceive the compressed sound as expected. To provide better hearing assistance for listeners, the DRC processing should be extended to deal with the auditory masking. Similarly, for the designs of the NR and SCE processing, better hearing assistance can be achieved by extending them to deal with the auditory information of hearing impaired listeners.

Further, considering a design that performs DRC processing on the input sound of each ear separately. The ratio of the sound pressures of the two ears at each frequency will be changed after the DRC processing due to the difference on the input spectra and the compression characteristics between ears. This may affect the binaural sound localization or related operations.

Furthermore, in a serial signal processing configuration, the functions of a processing stage may be cancelled out by the processing of subsequent stages, for example in FIG. 2, the processing effects of the NR module 160 and the SCE module 170 can be partially cancelled by that of the DRC module 180. It is caused by the independent, irrelevant or sometimes conflicting design goals between signal processing stages. Though the issue can be dealt with by providing side information to the subsequent modules, such as passing a signal quality vector of the NR module 160 to the DRC module 180 in FIG. 2, the complexity of subsequent modules grows quickly as long as more processing stages and side information are engaged. The aforementioned issues have to be resolved by new designs on either module level or architecture level.

REFERENCE DOCUMENTS

1: Dutoit, Thierry, and Ferran Marques. *Applied Signal Processing: A MATLABT™-based proof of concept*. Springer Science & Business Media, 2010.

2: Loizou, Philipos C. Speech enhancement: theory and practice. CRC press, 2013.

3: Kates, James M. Digital hearing aids. Plural publishing, 2008.

4: Dillon, Harvey. Hearing aids. Second edition. Boomerang Press, 2012.

5: Lybarger S F. (Jul. 3, 1944). U.S. Pat. No. 543,278.

6: J. Chalupper, H. Fastl: Dynamic loudness model (DLM) for normal and hearing-impaired listeners. Acta Acustica united with Acustica 88 (2002) 378-386.

7: B. R. Glasberg, B. C. J. Moore: A model of loudness applicable to time-varying sounds. J. Audio Eng. Soc. 50 (2002) 331-341.

8: B. C. J. Moore and B. R. Glasberg, "A revised model of loudness perception applied to cochlear hearing loss," Hearing Research, vol. 188, pp. 70-88, 2004.

9: Gerkmann, Timo, Martin Krawczyk-Becker, and Jonathan Le Roux. "Phase processing for single-channel speech enhancement: History and recent advances." IEEE Signal Processing Magazine 32.2 (2015): 55-66.

10: Y. Shao and C. H. Chang, "A generalized time-frequency subtraction method for robust speech enhancement based on wavelet filter banks modeling of human auditory system," IEEE Trans. Systems, Man, and Cybernetics-Part B: Cybernetics, vol. 37(4), pp. 877-889, 2007.

SUMMARY

In view of above issues, an object of the present invention is to provide a joint spectral gain adaptation (hereinafter abbreviated as JSGA) module and a method thereof, and a corresponding audio processing system and an implementation method thereof. This design is based on a loop to feedback the difference between the output signals of the two loudness models adapted with the listener to shape the sound spectrum. Extra audio signal processing functions can be further inserted in the loop as needed, and the interaction of them is dealt with to improve the listener's perception. By applying loudness models, the JSGA design integrates the signal processing functions and associates them with the listener's hearing information to provide more appropriate hearing assistance to hearing impaired listeners.

A first aspect of the present invention provides a JSGA module comprising:

an aided-ear loudness (hereinafter abbreviated as AL) model, wherein an AL spectrum is obtained by performing computations on an aided-ear threshold elevation (hereinafter abbreviated as ATE) profile and a spectrum selected from the group consisting of an input spectrum and a first spectrum derived from the input spectrum;

a bare-ear loudness (hereinafter abbreviated as BL) model, wherein a BL spectrum is obtained by performing computations on a bare-ear threshold elevation (hereinafter abbreviated as BTE) profile and a modified spectrum previously obtained; and a spectrum shaping (hereinafter abbreviated as SS) sub-module, wherein the modified spectrum previously obtained is passed to the BL model as an input, and a modified spectrum and a linear spectral gain (hereinafter abbreviated as LSG) vector are obtained by performing computations on the input spectrum, the BL spectrum, and a loudness spectrum selected from the group consisting of the AL spectrum and a first loudness spectrum derived from the AL spectrum.

A second aspect of the present invention provides an audio processing system comprising a JSGA module according to the first aspect, wherein a modified spectrum is obtained by performing computations on an ATE profile, a BTE profile, and an input spectrum of each frame period, the audio processing system further comprising:

an ADC unit and a DI signal obtained by performing sampling on an AI signal at a sampling period;

a FWA unit, wherein the input spectrum of each frame period is obtained by performing framing and waveform analysis on the DI signal;

a waveform synthesis unit and a DO signal obtained by performing waveform synthesis on the modified spectrum; and a DAC unit, wherein the DO signal is converted into an AO signal at the sampling period.

A third aspect of the present invention provides an audio processing system comprising a JSGA module according to the first aspect, wherein a LSG vector is obtained by performing computations on an ATE profile, a BTE profile, and an input spectrum of each time interval, the audio processing system further comprising:

an ADC unit and a DI signal obtained by performing sampling on an AI signal at a sampling period;

an analysis filter bank and a plurality of sub-band signals obtained by performing sub-band filtering on the DI signal;

a sub-band snapshot unit, wherein the input spectrum of each time interval is obtained by performing simultaneous sampling on each sub-band signal at a time interval and ranking the simultaneously sampled values according to their corresponding sub-band center frequencies;

a sub-band signal combining unit and a DO signal obtained by performing weighted combining on the sub-band signals according to the LSG vector corresponding to each sampling period; and a DAC unit, wherein the DO signal is converted into an AO signal at the sampling period.

A fourth aspect of the present invention provides a JSGA method applied to a JSGA module comprising an AL model, a BL model and a SS sub-module, the JSGA method comprising the following steps:

obtaining an AL spectrum with the AL model by performing computations on an ATE profile and a spectrum selected from the group consisting of an input spectrum and a first spectrum derived from the input spectrum;

passing a modified spectrum previously obtained from the SS sub-module to the BL model as an input, and obtaining a BL spectrum with the BL model by performing computations on a BTE profile and a modified spectrum previously obtained; and obtaining a modified spectrum and a LSG vector with the SS sub-module by performing computations on the input spectrum, the BL spectrum, and a loudness spectrum selected from the group consisting of the AL spectrum and a first loudness spectrum derived from the AL spectrum.

A fifth aspect of the present invention provides a method of implementing an audio processing system comprising a step of implementing a JSGA method with a JSGA module according to the fourth aspect by performing computations on an ATE profile, a BTE profile, and an input spectrum of each frame period to obtain a modified spectrum, the method of implementing the audio processing system further comprising the following steps:

performing sampling on an AI signal at a sampling period with an ADC unit to obtain a DI signal;

performing framing and waveform analysis on the DI signal with a FWA unit to obtain the input spectrum of each frame period;

performing waveform synthesis on the modified spectrum with a waveform synthesis unit to obtain a DO signal; and converting the DO signal into an AO signal at the sampling period with a DAC unit.

A sixth aspect of the present invention provides a method of implementing an audio processing system comprising a step of implementing a JSGA method with a JSGA module according to the fourth aspect by performing computations on an ATE profile, a BTE profile, and an input spectrum of each time interval to obtain a LSG vector, the method of implementing the audio processing system further comprising the following steps:

performing sampling on an AI signal at a sampling period with an ADC unit to obtain a DI signal;

performing sub-band filtering on the DI signal with an analysis filter bank to obtain a plurality of sub-band signals;

performing simultaneous sampling on each of the plurality of sub-band signals at a time interval and ranking the simultaneously sampled values according to their corresponding sub-band center frequencies with a sub-band snapshot unit to obtain the input spectrum of each time interval;

performing weighted combining on the plurality of sub-band signals according to the LSG vector corresponding to each sampling period with a sub-band signal combining unit to obtain a DO signal; and converting the DO signal into an AO signal at the sampling period with a DAC unit.

DETAILED DESCRIPTION

To make the present invention better understood by those skilled in the art to which the present invention pertains, preferred embodiments of the present invention are detailed below with the accompanying drawings to clarify the composition of the present invention and effects to be achieved.

Figure 1:
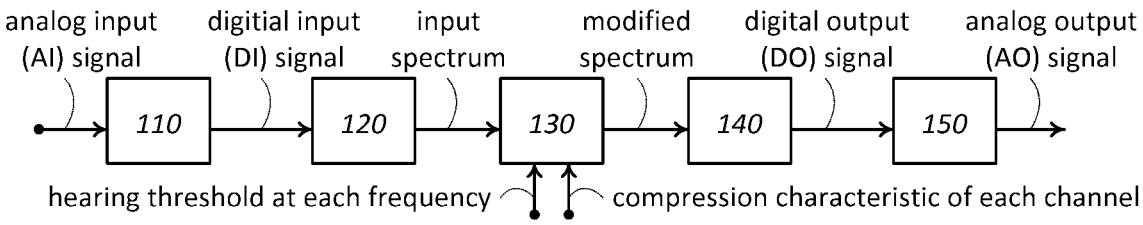
FIG. 1 is a block diagram of an architecture of a conventional frequency domain audio processing system.
Figure 2:
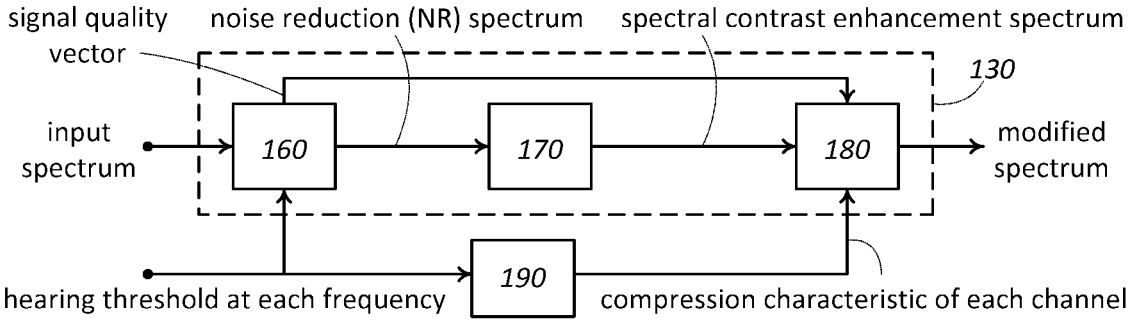
FIG. 2 is a block diagram of a conventional spectrum modification module.
Figure 3:
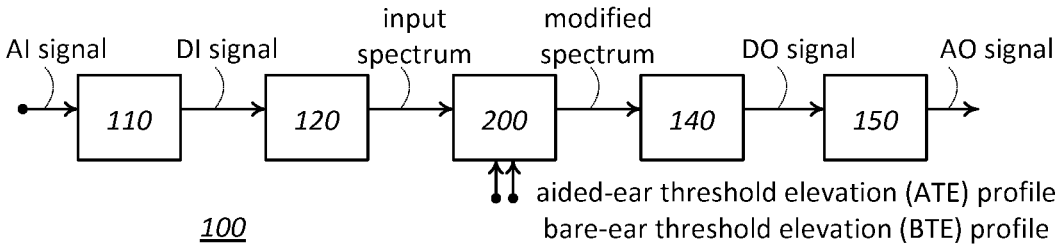
FIG. 3 is a block diagram of an audio processing system according to a first embodiment of the present invention.

FIG. 3 is the block diagram of the audio processing system according to the first embodiment of the present invention, wherein the audio processing system 100 comprises an ADC unit 110, a FWA unit 120, a JSGA module 200, a waveform synthesis unit 140, and a DAC unit 150.

The ADC unit 110 is used to obtain a DI signal by performing sampling on an AI signal at a time period. The AI signal and the DI signal are of monaural type (in the present invention, it means that information is associated with a single ear). The time period is referred to as the sampling period. Further, if the input signal has been digitized, the ADC unit 110 is not required.

The FWA unit 120 is used to obtain an input spectrum of monaural type of each frame period by performing framing and waveform analysis on the DI signal obtained from the ADC unit 110. Framing is used to arrange the samples of the DI signal into a sequence of equal-length, evenly-spaced, and partially-overlapped waveform frames. Assuming that each waveform frame contains $N_{DATA}$ samples where $N_{OVL}$ samples are overlapped between two consecutive waveform frames, each waveform frame corresponds to a time interval of $(N_{DATA}-N_{OVL})$ sampling periods, and the time interval is referred to as the frame period.

Waveform analysis is used to obtain an input spectrum of each frame period by analyzing the waveform frame of corresponding frame period. For details of the spectral analysis such as the short-time Fourier transform, refer to reference document 1.

The JSGA module 200 is used to obtain a modified spectrum and a LSG vector (not shown in FIG. 3; only used inside the JSGA module 200 in this embodiment) by performing computations on an ATE profile, a BTE profile, and the input spectrum of each frame period obtained from the FWA unit 120. The ATE profile, the BTE profile, the modified spectrum, and the LSG vector are of monaural type.

The waveform synthesis unit 140 is used to obtain a DO signal of monaural type by performing waveform synthesis such as the inverse short-time Fourier transform on the modified spectrum obtained from the JSGA module 200, that is, reconstructing a waveform frame with the modified spectrum of each frame period, weighting the reconstructed waveform frames corresponding to the adjacent frame periods by a window function, and performing overlap-addition on the weighted frames. For details of the inverse short-time Fourier transform, refer to reference document 1.

The DAC unit 150 is used to convert the DO signal obtained from the waveform synthesis unit 140 into an AO signal of monaural type at the sampling period. Further, the DO signal can also be used for other processing or stored as a digital recording file, where the DAC unit 150 is omitted in such aspect.

Figure 4:
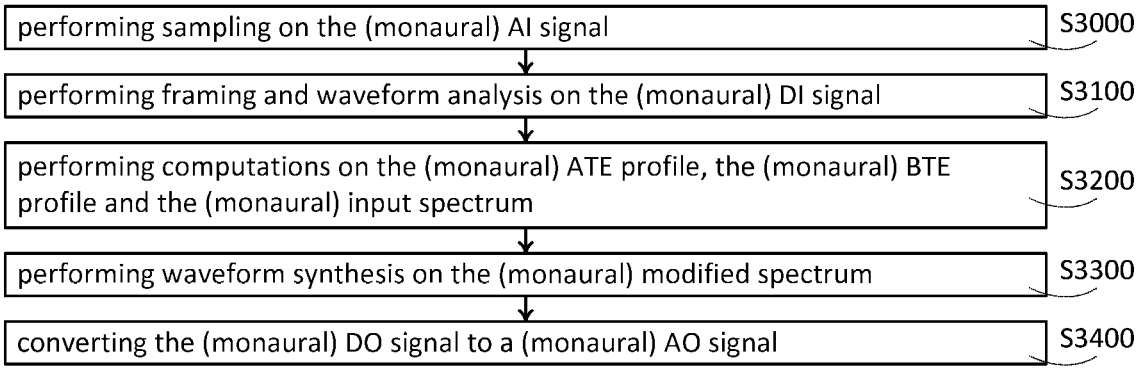
FIG. 4 is a flowchart of a method of implementing the audio processing system according to the first embodiment of the present invention.

FIG. 4 is the flowchart of the method of implementing the audio processing system according to the first embodiment of the present invention. In describing flow steps of FIG. 4, the system architecture of FIG. 3 and its corresponding text are referred. Though the flow steps are for continuous-type audio processing, each step is a segment-based operation where a signal segment or spectrum obtained from a preceding step at each time interval can be taken to perform computations immediately, rather than perform computations after the entire signal or all spectra obtained.

In the first embodiment, a DI signal is obtained with the ADC unit 110 by performing sampling on an AI at a time period. The AI signal and the DI signal are of monaural type. The time period is called a sampling period (step S3000).

Referring to paragraphs [0021] to [0022], an input spectrum of monaural type of each frame period is obtained with the FWA unit 120 by performing framing and waveform-analysis on the DI signal obtained from the ADC unit 110 (step S3100).

A modified spectrum is obtained with the JSGA module 200 by performing computations on an ATE profile, a BTE profile, and the input spectrum of each frame period obtained from the FWA unit 120. The ATE profile, the BTE profile, and the modified spectrum are of monaural type (step S3200). The structure and operation method of various embodiments of the JSGA module 200 in a monaural audio processing system or application are described below, and the supplementary description is made for the corresponding adjustment of the signal, structure and operation method of the JSGA module 200 in a binaural audio system or application.

Referring to paragraph [0024], a DO signal of monaural type is obtained with the waveform synthesis unit 140 by performing waveform synthesis on the modified spectrum obtained from the JSGA module 200 (step S3300).

The DO signal obtained from the waveform synthesis unit 140 is converted into an AO signal of monaural type at the sampling period with the DAC unit 150 (step S3400).

Figure 5:
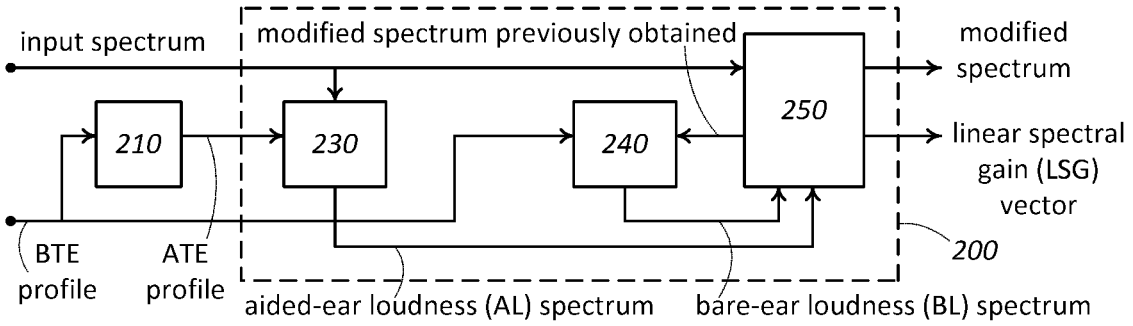
FIG. 5 is a block diagram of a JSGA module of the present invention.

In the block diagram of the JSGA module of the present invention of FIG. 5, the audio processing system 100 (see FIG. 3) further comprises a fitting procedure 210 which is used to determine the ATE profile according to the BTE profile.

The subject's hearing threshold at each frequency can be obtained by interpolating the result of the pure tone audiometry (hereinafter abbreviated as PTA, measuring the hearing thresholds at specified frequencies and recording them in decibels). A threshold elevation profile contains the amount of elevation of the subject's hearing threshold relative to the corresponding NH threshold at each frequency, where the NH threshold is the expectation value of the hearing threshold of NH young listeners which is typically 6 to 10 dB higher than the NH threshold of binaural listening in reference document 7. If the listener is subjected to a single-ear PTA without wearing an assistive device, the monaural bare-ear hearing threshold at each frequency can be obtained, and the BTE profile of monaural type is derived as:

$$\Delta T_{BARE}(z)=T_{q,BARE}(z)-T_{q,NH}(z) \tag{1}$$

where $\Delta T_{BARE}$ (z), $T_{q,BARE}$(z) and $T_{q,NH}$ (z) denote the value of the BTE profile, the bare-ear hearing threshold and the NH threshold at the frequency z, respectively. In a binaural system or application, the PTA is performed on both ears of the subject, and the result values are interpolated to obtain both a left-ear bare-ear hearing threshold and a right-ear bare-ear hearing threshold at each frequency, thus to obtain a BTE profile of binaural type (in the present invention, it means that information includes two monaural counterparts associated with the left and right ears of a listener, respectively).

The ATE profile contains the amount of elevation of the measured hearing threshold relative to the NH threshold at each frequency when the subject wears an assistive device during test. It is used as a setting of the corrected hearing ability rather than the result of a hearing test. In FIG. 5, the ATE profile is determined with the fitting procedure 210 according to the BTE profile. In monaural audio processing systems or applications, the ATE profile is of monaural type. To correct the value of BTE profile at frequency z with a correction ratio φ(z) between 0 and 1, we have:

$$\Delta T_{AIDED}(z)=\Delta T_{BARE}(z)-\varphi(z)\cdot\Delta T_{BARE}(z) \tag{2}$$

$$T_{q,AIDED}(Z)-(1-\varphi(z))\cdot T_{q,BARE}(z)\cdot\varphi(z)\cdot T_{q,NH}(z) \tag{3}$$

where $\Delta T_{AIDED}$(z) denotes the value of the ATE profile at the frequency z, and other notations are as aforementioned.

In Eq. (3), the aided-ear hearing threshold is expressed as a linear interpolation of the bare-ear hearing threshold and the NH threshold according to the correction ratio φ(z). Setting of φ(z)=0 implies that no correction on the amount of threshold elevation and the original hearing ability is maintained. Setting of φ(z)=½ implies half amount of the hearing threshold elevation is corrected, making the result of audiometry after correction close to that of the "½-gain rule"

disclosed in reference document 5 which is simple and easy to be adopted. Further, the correction ratio corresponding to the frequency with severe threshold elevation has to be reduced in practices, that is, $\varphi(z)$ is decreased as the value of the BTE profile $\Delta T_{BARE}(z)$ at the frequency z increased to avoid listening discomfort. In a binaural system or application, a left-ear correction ratio and a right-ear correction ratio of each frequency is determined according to the BTE profile and an ATE profile of binaural type is derived with the fitting procedure 210.

FIG. 5 is the basic structure of the JSGA module 200 of the present invention, comprising an AL model 230 with characteristics determined by an ATE profile, a BL model 240 with characteristics determined by a BTE profile, and a SS sub-module 250.

The present invention argues that the listener's original hearing loss and the expected amount of correction on hearing loss should be both taken into account in an audio processing to shape the input spectra, so as to provide appropriate effects to the listener. The argument is employed by the design of the JSGA module and its variants of the present invention, wherein the loudness models of the JSGA module are used to associate the original and expected hearing loss conditions of the listener with the corresponding sound perception behaviors, and to translate the sounds into loudness spectra (in the present invention, a loudness spectrum is a vector representation of the listener's loudness perception at each frequency).

Specifically, the BL model 240 of FIG. 5 corresponds to the perception behavior of the listener before wearing an assistive device, while the AL model 230 corresponds to the expected perception behavior of the listener after wearing the assistive device. Consider that the modified spectrum obtained from the JSGA module 200 (corresponding to a system output sound) is fed back to the BL model 240 to obtain a BL spectrum, and the input spectrum (corresponding to a system input sound) is passed to the AL model 230 to obtain an AL spectrum, the BL spectrum will gradually approximate the AL spectrum as the spectral gain continues to be adjusted by the SS sub-module 250.

The audio signals in real life are usually continuously changing. When the JSGA module 200 receives the audio signals and operates, the difference between the BL spectrum and the AL spectrum (hereinafter referred to as the loudness spectrum error vector) will be continuously presented. Such loudness spectrum error vector is used to adjust the signal gain of each frequency to correct the loudness perception of the listener to achieve the expected effect of hearing assistance.

Unlike conventional designs that adjust the signal gain of each frequency step by step with various types of audio processing, the JSGA module of the present invention operates according to the feedback of the loudness spectrum error vector, and further combines various audio processing functions in the loop computations according to the functional requirements of the system, so as to associate various psychoacoustic effects of the listener with the audio processing functions and to integrate the functions to dynamically adjust the signal gain of each frequency.

In FIG. 5, an AL spectrum is obtained with the AL model 230 by performing computations on the ATE profile and the input spectrum obtained from the FWA unit 120 (see FIG. 3), wherein the ATE profile contains the amount of elevation of an aided-ear hearing threshold relative to a NH threshold at each frequency. The input spectrum and the AL spectrum are of monaural type. In some variants of the JSGA module described below, a spectrum derived from the input spectrum is an input of the AL model 230 in place of the input spectrum. In a binaural system or application, the input spectrum and the AL spectrum are of binaural type.

A BL spectrum is obtained with the BL model 240 by performing computations on the BTE profile and the modified spectrum previously obtained from the SS sub-module 250, wherein the BTE profile contains the amount of elevation of a bare-ear hearing threshold relative to the NH threshold at each frequency. The modified spectrum and the BL spectrum are of monaural type. When the JSGA module 200 start to perform computations, the modified spectrum previously obtained (i.e. the initial setting of the modified spectrum) can be set equal to the input spectrum. In a binaural system or application, the modified spectrum and the BL spectrum are of binaural type.

The modified spectrum previously obtained from the SS sub-module 250 is passed to the BL model 240, and a modified spectrum and a LSG vector of monaural type are obtained with the SS sub-module 250 by performing computations on the input spectrum obtained from the FWA unit 120, the AL spectrum obtained from the AL module 230 and the BL spectrum obtained from the BL model 240 (in the next turn of the JSGA module operation, the modified spectrum becomes an input of the BL model 240 which is referred to as modified spectrum previously obtained). In some variants of the JSGA module described below, a loudness spectrum derived from the AL spectrum is an input of the SS sub-module 250 in place of the AL spectrum. In a binaural system or application, a modified spectrum and a LSG vector of binaural type are obtained with the SS sub-module 250 by performing computations on the left-ear part and the right-ear part of the input signals (such as the input spectrum, the AL spectrum, and the BL spectrum) separately.

Figure 6:
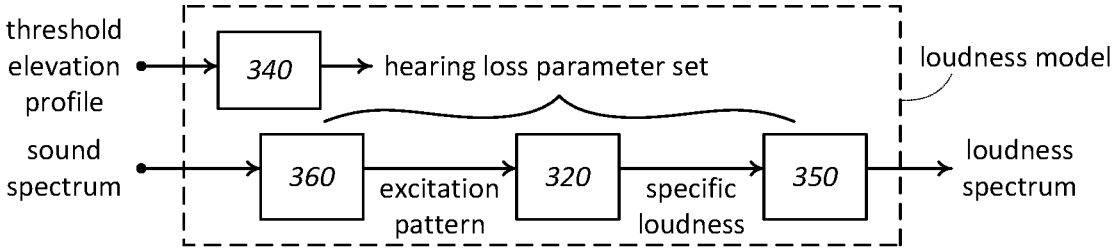
FIG. 6 is a block diagram of a loudness model of the present invention.

FIG. 6 is the block diagram of the loudness model of the present invention which is applied to the AL model 230 and the BL model 240 of FIG. 5. The loudness model comprises a hearing loss model 340, a spectrum-to-excitation pattern conversion sub-module 360, a specific loudness estimation sub-module 320, and a temporal integration sub-module 350.

In the field of psychoacoustics, loudness models are used to evaluate the listener's perception of sound intensity affected by the input sound and various parameters. The loudness value corresponds to the neural activity of an auditory system corresponding to the sound over a certain time period. In reference documents 6 and 7 the implementation details of different loudness models are illustrated. Those loudness models can handle time-varying wide-band sounds covering sounds presenting in real life, hence are suitable for the JSGA module of the present invention after adjusting the computations according to the interface signal formats of the AL model 230 and the BL model 240. Moreover, since the JSGA module 200 performs feedback adjustment according to the loudness spectrum error vector, responding the loudness changes caused by the difference of the hearing loss is more important to the loudness model than providing accurate loudness estimations. Deleting part of the computations not affected by the hearing loss helps to reduce the computational cost of the loudness models.

The hearing loss model 340 is used to derive a hearing loss parameter set with a threshold elevation profile (i.e. either the ATE profile or the BTE profile of FIG. 5). In reference document 6, a method of dividing the hearing loss into two components was proposed, which account for the recruitment effect and the hearing threshold elevation effect. In reference document 8, the issue of cochlear hearing loss that affects the loudness perception in several aspects was illustrated, such as reducing sensitivity, reducing compressive nonlinearity, reducing inner-hair-cell (IHC)/neural function and reducing frequency selectivity. A method for deriving the changes of the model parameters was proposed accordingly to make the loudness model respond the degradation of the loudness perception due to the hearing loss in more detail. In a binaural system or application, the hearing loss model 340 is used to derive a hearing loss parameter set including a left-ear hearing loss parameter set and a right-ear hearing loss parameter set by performing aforementioned computations on the left-ear threshold elevation profile and the right-ear threshold elevation profile of the threshold elevation profile, respectively.

The conventional loudness model performs filtering and filter bank processing (or their equivalent processing) on the time-domain input signal to account for the filtering and frequency division functions corresponding to the outer ears to the inner ears of the auditory system, and to estimate an output level of each filter of the filter bank (hereinafter referred to as an auditory excitation). A vector where the auditory excitations are ranked according to the corresponding filter center frequencies are referred to as an excitation pattern.

Since the input of the loudness model of the present invention is a spectrum, the spectrum-to-excitation pattern conversion sub-module 360 is used to obtain an excitation pattern of monaural type by performing computations on a sound spectrum of monaural type. Each auditory excitation in the excitation pattern is calculated as:

$$E_p=\Sigma_k|X(k)|^2|G(k)H_p(k)|^2 \tag{4}$$

where p denotes the filter index, $H_p(k)$ and $E_p$ denote the frequency response of the p-th filter and the corresponding auditory excitation, respectively, X(k) denotes the input sound spectrum of the loudness model, and G(k) denotes the lumped frequency response of the outer ear and middle ear which can be referred to reference documents 7, 8. Depending on the loudness model in used, the filter bank can be either with fixed coefficients (referring to reference document 6, using fixed filters) or with time-varying coefficients (referring to reference document 8, adjusting the filter response according to the hearing loss and the input sound level). In a binaural system or application, the spectrum-to-excitation pattern conversion sub-module 360 is used to obtain an excitation pattern of binaural type by performing aforementioned monaural computations on a left-ear sound spectrum and a right-ear sound spectrum of a sound spectrum separately.

The specific loudness estimation sub-module 320 is used to obtain a specific loudness of monaural type (in the present invention, a specific loudness is a vector of the instantaneous loudness information of a sound over frequency) by performing computations on the excitation pattern obtained from the spectrum-to-excitation pattern conversion sub-module 360 according to the hearing loss parameter set obtained from the hearing loss model 340. The computations include sub-models of the loudness model in used. Taking the loudness model of reference document 6 as an example, the computations include the loudness transformation, the forward masking, and the upward spread of masking. Taking the loudness model of reference document 8 as an example, the computations include the reduction on IHC/neural function and the loudness transformation. In a binaural system or application, the specific loudness estimation sub-module 320 is used to obtain a specific loudness of binaural type by performing the aforementioned computations on the excitation pattern according to the hearing loss parameter set obtained from the hearing loss model 340.

The temporal integration sub-module 350 is used to obtain a loudness spectrum of monaural type by performing computations on the specific loudness obtained from the specific loudness estimation sub-module 320. Referring to loudness models in reference documents 6 and 7, the specific loudness is integrated over frequency and the result is fed to a temporal integration model to approximate the effect of loudness perception getting stronger with the increasing of the sound duration. Since the loudness models of the present invention have to generate the frequency-dependent loudness information, the aforementioned integration over frequency is omitted while the temporal integration is applied on each element of the specific loudness. In a binaural system or application, the temporal integration sub-module 350 is used to obtain a loudness spectrum of binaural type by performing computations on the left-ear specific loudness and the right-ear specific loudness of the specific loudness separately.

Figure 7:
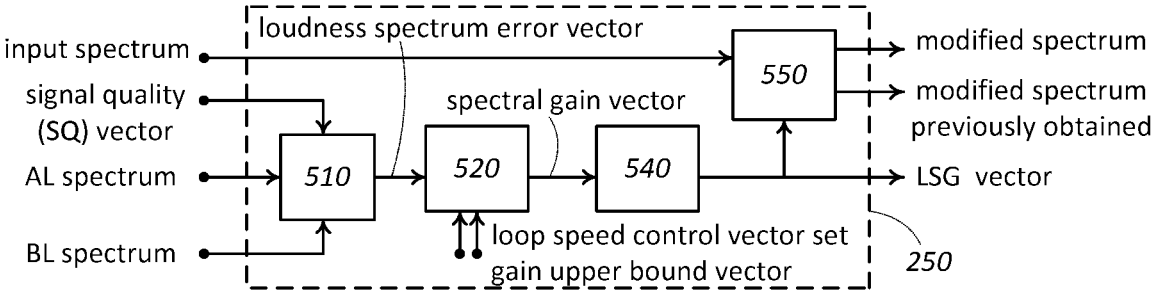
FIG. 7 is a block diagram of a SS sub-module of the present invention.

FIG. 7 is the block diagram of the SS sub-module of the present invention, wherein the SS sub-module 250 comprises an error measurement sub-module 510, a gain adjustment sub-module 520, a format conversion sub-module 540, and a spectrum scaling sub-module 550.

The error measurement sub-module 510 is used to obtain a loudness spectrum error vector by performing computations on the AL spectrum obtained from the AL model 230 and the BL obtained from the BL model 240:

$$L_{ERR.dB}(z)=10\cdot\log_{10}(L_{AIDED}(z))-10\cdot\log_{10}(L_{BARE}(z)) \tag{5}$$

where $L_{ERR.dB}(z)$ $L_{BARE}(z)$, and $L_{AIDED}(z)$ denote the values of the loudness spectrum error vector, the BL spectrum, and the AL spectrum at the frequency z, respectively. In this embodiment, the signal quality (hereinafter abbreviated as SQ) vector of FIG. 7 is not used as the input signal of the SS sub-module 250 of FIG. 5, while in some variants of the JSGA module described below, it is an input signal of the SS sub-module 250, and the loudness spectrum error vector of Eq. (5) is modified as:

$$L_{ERR.dB}(z)=10\cdot\log_{10}(L_{AIDED}(z)\cdot W_{SQ}(z))-10\cdot\log_{10}(L_{BARE}(z)) \tag{6}$$

where $W_{SQ}(z)$ denotes the value of the SQ vector at the frequency z, and other notations are as aforementioned. In practice, $W_{SQ}(z)$ can be approximated by the element of the SQ vector that corresponds to the frequency closest to z. The purpose of weighting the AL spectrum by the SQ vector in Eq. (6) is to suppress the spectral gains corresponding to the low signal quality spectrum components to prevent computations of the SS sub-module 250 from enhancing the noise or interference of the input signal.

The gain adjustment sub-module 520 is used to adjust a spectral gain vector according to the loudness spectrum error vector obtained from the error measurement sub-module 510:

$$G_{dB,tmp}=\begin{cases} G_{dB,last}(z)+L_{ERR,dB}(z)\cdot C_{REL}(z) & \text{if } L_{ERR,dB}(z)\geq 0 \\ G_{dB,last}(z)+L_{ERR,dB}(z)\cdot C_{ATT}(z) & \text{if } L_{ERR,dB}(z)<0 \end{cases} \tag{7}$$

$$G_{dB}(z)=\begin{cases} G_{dB,MAX}(z) & \text{if } G_{dB,tmp}\geq G_{dB,MAX}(z) \\ G_{dB,tmp} & \text{if } G_{dB,tmp}<G_{dB,MAX}(z) \end{cases} \tag{8}$$

where $G_{dB,tmp}$ denotes a temporary variable, $G_{dB,last}(z)$, $G_{dB}(z)$, and $G_{dB,MAX}(z)$ denote the values of the spectral gain vector before adjustment, the spectral gain vector after adjustment, and the gain upper-bound vector at the frequency z, respectively, $C_{ATT}(z)$ and $C_{REL}(z)$ denote the values of the loop speed control vector set at the frequency z, and are applied to loudness spectrum errors in negative sign and positive sign, respectively, and other notations are as aforementioned. When the JSGA module 200 start to perform computations, the spectral gain vector before adjustment (i.e. the initial setting of the spectral gain vector) can be set to all zeros to match the initial setting of the modified spectrum identical to the input spectrum.

The format conversion sub-module 540 is used to convert the spectral gain vector obtained from the gain adjustment sub-module 520 into a LSG vector, by performing the frequency axis adjustment and the decibel-to-linear domain conversion described as follows:

(i) Frequency axis adjustment: if a plurality of frequencies corresponding to each element of a vector, a spectrum, or a loudness spectrum are ranked into a frequency vector, the frequency vector is called the frequency axis of the vector, the spectrum, or the loudness spectrum. To properly scale the input spectrum, the spectral gain vector is adjusted in a way of matching the frequency axis with that of the input spectrum obtained from the FWA unit 120. The step is omitted if the frequency axes of the two vectors are identical, otherwise the following interpolation is calculated:

$$\tilde{G}_{dB}(k) = \begin{cases} \frac{z_U - z_k}{z_U - z_L} \cdot G_{dB}(z_L) + \frac{z_k - z_L}{z_U - z_L} \cdot G_{dB}(z_U) & \text{if } z_L \le z_k < z_U \\ G_{dB}(z_{MAX}) & \text{if } z_k > z_{MAX} \end{cases} \quad (9)$$

where $\tilde{G}_{dB}$ (k) and $z_k$ denote the spectral gain and the frequency after frequency axis adjustment corresponding to vector index k, respectively, $z_L$, $z_U$, and $z_{MAX}$ denote the two frequencies, low ($z_L$) and high ($z_U$), closest to $z_k$ on the frequency axis of the spectral gain vector and the highest frequency of the frequency axis, respectively, and $z_U$, and $z_{MAX}$ correspond to the elements of the spectral gain vector $G_{dB}(z_L)$, $G_{dB}(z_U)$, and $G_{dB}(z_{MAX})$, respectively.

(ii) Decibel-to-linear domain conversion: each element of the spectral gain vector after frequency axis adjustment $\tilde{G}_{dB}(k)$ is passed through an exponential function to obtain the LSG vector $G_{JSGA}$:

$$G_{JSGA}(k)=10^{0.1\cdot\tilde{G}_{dB}(k)} \quad (10)$$

The spectrum scaling sub-module 550 is used to pass the modified spectrum previously obtained to the BL model 240, and obtain a modified spectrum by scaling the input spectrum according to the LSG vector:

$$X_{MOD}(k)=G_{JSGA}(k)\cdot X_{IN}(k) \quad (11)$$

where $X_{IN}(k)$, $G_{JSGA}(k)$, and $X_{MOD}(k)$ denote the values of the input spectrum, the LSG vector, and the modified spectrum at vector index k, respectively.

Figure 8:
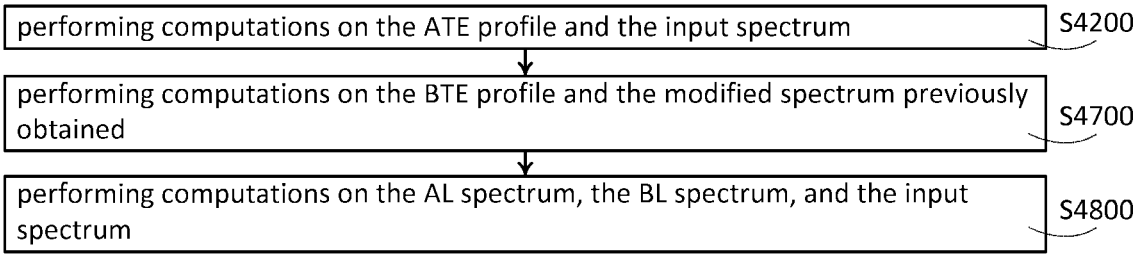
FIG. 8 is a flowchart of a JSGA method of the present invention.

FIG. 8 is the flowchart of the JSGA method of the present invention. The component structures of FIG. 5 to FIG. 7 and the corresponding texts are referred for illustrating steps of FIG. 8.

In FIG. 8, referring to paragraphs [0032] to [0035], [0044] to [0050], an AL spectrum is obtained with the AL model 230 by performing computations on an ATE profile obtained by the fitting procedure 210 and an input spectrum obtained from the FWA unit 120 (step S4200).

Referring to paragraphs [0044] to [0050] and [0055], a modified spectrum previously obtained from the spectrum shaping sub-module 250 is passed to the BL model 240, and a BL spectrum is obtained with the BL model 240 by performing computations on a BTE profile and the modified spectrum previously obtained (step S4700). Further, because of no data dependency between step S4700 and step S4200, step S4700 can also be executed before or in parallel with step S4200 without changing computation results. FIG. 8 just shows a possible flow.

Referring to paragraphs [0051] to [0055], a modified spectrum and a LSG vector are obtained with the SS sub-module 250 by performing computations on the input spectrum, the AL spectrum obtained from the AL model 230 and the BL obtained from the BL model 240 (step S4800).

The JSGA module 200 of the present invention performs computations on the input spectrum of each frame period, where the frame period is typically set between a few milliseconds and tens of milliseconds. With the current hardware capability, such computations can be easily performed more than once in this period. Therefore, the JSGA module 200 of the present invention can be modified to support iterative processing, that is, to perform more than one turn of computations of the BL model 240 and the SS sub-module 250 in one frame period, thereby reducing the value of each element of the loudness spectrum error vector.

The iterative processing is carried out in each frame period by either running a fixed number of iterations, or running iterations according to a weighted sum of the loudness spectrum error vector (hereinafter referred to as loudness spectrum difference). The latter is employed in the embodiments presented below.

By determining whether or not to continue the iterative processing according to the loudness spectrum difference, iterations mainly occur in the frame periods with relatively large loudness spectrum fluctuations over time. Due to its low probability of occurrence, this approach is good to control the average number of iterations per frame and maintain the quality of loop convergence.

Figure 9:
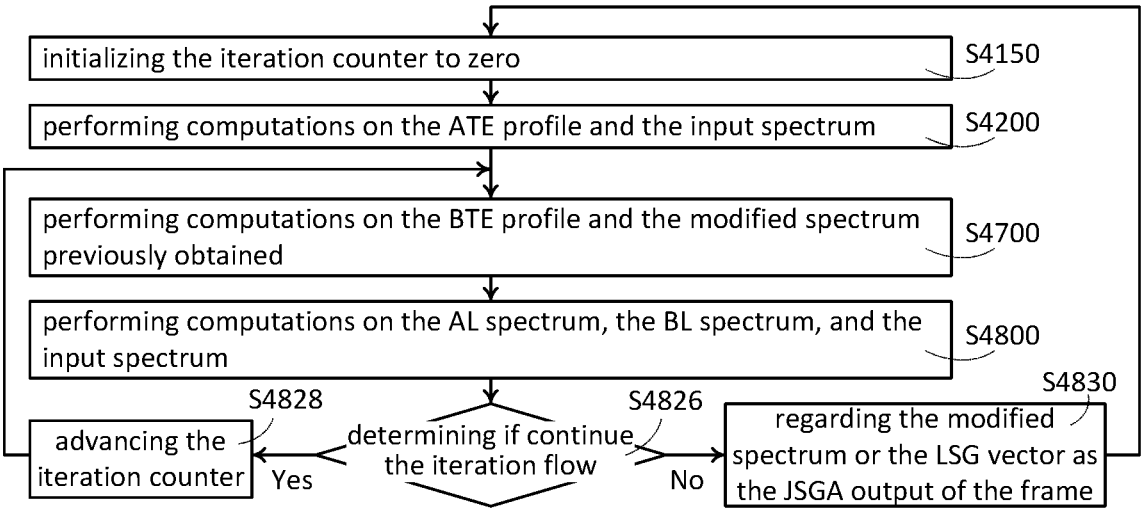
FIG. 9 is a flowchart of a variant of iterative processing of the JSGA module of the present invention.

To conduct iterative processing, the frame operation flow of the JSGA module 200 is changed to the flowchart of the variant of iterative processing of the JSGA module of the present invention shown in FIG. 9, which includes the following steps: at the beginning of the operation corresponding to each frame period, the iteration count is set to zero to clear the count value of the previous frame period (step S4150).

Next, the steps of FIG. 9 that are identical to steps S4200, S4700, and S4800 of FIG. 8 are executed in order. The corresponding step descriptions are identical to the foregoing and are omitted.

Then, whether or not to continue the iterative processing is determined (step S4826). If the loudness spectrum difference is excessive and the iteration count does not exceed the iteration count limit, the iteration count is advanced (step S4828) and the processing flow is continued from step S4700 of FIG. 9; if not, the modified spectrum latest obtained from the SS sub-module 250 is regarded as the modified spectrum obtained from the JSGA module 200 of the present frame period (step S4830), and the flow is returned to step S4150 of FIG. 9 to perform computations of the JSGA module 200 corresponding to the next frame period.

The criterion of excessive loudness spectrum difference in step S4826 is:

$$\frac{\sum_z S(z)\cdot|L_{AIDED}(z) - L_{BARE}(z)|}{\sum_z L_{AIDED}(z)} > R_{ERR} \quad (12)$$

where $R_{ERR}$ denotes the threshold of the loudness spectrum difference, $L_{BARE}(z)$, $L_{AIDED}(z)$, and S(z) denote the values of the BL spectrum, the AL spectrum, and a weighting vector at the frequency z, respectively. In practice, the weighting S(z) of the frequency in the hearing insensitive region or the frequency with the spectral gain reaching the upper limit can be reduced to relax this criterion to reduce the average number of iterations. In a binaural system or application, the iterative processing of the JSGA module 200 is still performed with the flow of FIG. 9, while the criterion of step S4826 has to be extended for binaural processing according to the monaural loudness spectrum difference as the left side of the equal sign of Eq. (12), by deriving the left-ear loudness spectrum difference and the right-ear loudness spectrum difference, and then using either the sum of the two monaural loudness spectrum difference values or the maximum value of them as a binaural loudness spectrum difference. The criterion of excessive loudness spectrum difference becomes to check whether or not the binaural loudness spectrum difference exceeds the threshold $R_{ERR}$.

In each single iteration, the BL spectrum, the LSG vector, and the modified spectrum are obtained in order. If the loudness spectrum difference is lower than the threshold $R_{ERR}$ before the iteration count reaching the limit, it indicates that the criterion of loop convergence is met, and the computations corresponding to the next frame period can be performed accordingly.

To simplify texts and figures, iterative processing is not mentioned in flowcharts and text corresponding to the following embodiments of the JSGA module of the present invention. While the operation flow of each embodiment can be modified as FIG. 9 to support iterative processing by inserting a step of determining if to continue the operation flow from step S4700. Further, because of no data dependency between step S4700 and step S4200, step S4700 can also be executed before or in parallel with step S4200 without changing computation results. FIG. 9 just shows a possible flow.

Figure 10:
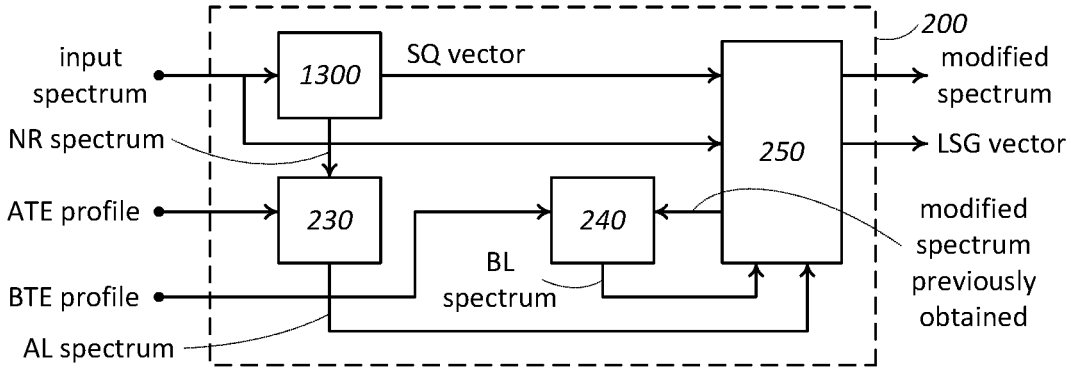
FIG. 10 is a block diagram of a first variant of the JSGA module of the present invention.

FIG. 10 is the block diagram of the first variant of the JSGA module of the present invention. As compared to the structure of the JSGA module 200 of FIG. 5, the JSGA module 200 of FIG. 10 further comprises a NR sub-module 1300.

The NR processing is aimed to suppress the noise of the sound based on the difference in characteristics between noise and speech, hopefully to increase the audibility or intelligibility of the sound. By attenuating the spectral components that are with relatively lower signal-to-noise ratios, the NR processing reduces the total noise power and improves the overall signal-to-noise ratio (hereinafter abbreviated as SNR) of the sound.

The NR sub-module 1300 is used to obtain a NR spectrum and a SQ vector of monaural type by performing NR processing on the input spectrum obtained from the FWA unit 120. In a binaural system or application, the NR sub-module 1300 is used to obtain a NR spectrum and a SQ vector of binaural type by performing NR processing on the left-ear input spectrum and the right-ear input spectrum of the input spectrum obtained from the FWA unit 120 separately.

Figure 11:
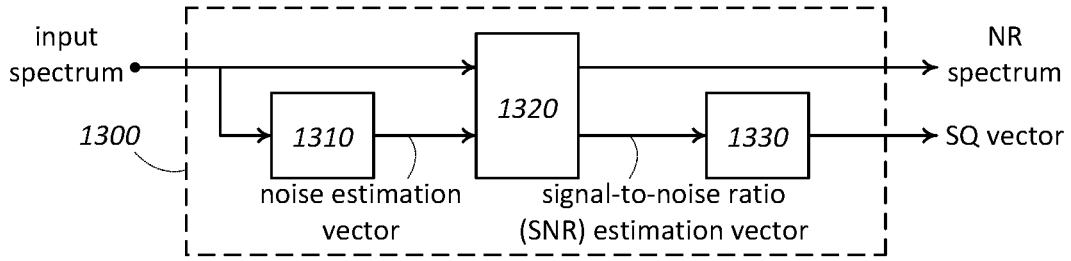
FIG. 11 is a block diagram of a NR sub-module of the present invention.

FIG. 11 is the block diagram of the NR sub-module of the present invention, wherein the NR sub-module 1300 comprises a noise estimation sub-module 1310, a signal estimation sub-module 1320 and a SQ estimation sub-module 1330.

The noise estimation sub-module 1310 is used to obtain a noise estimation vector by estimating the noise component of the input spectrum at each frequency. In the variants of the JSGA module of the present invention described below, if the AL spectrum is the input of the NR sub-module 1300, the noise estimation sub-module 1310 is used to obtain a noise estimation vector by estimating the noise component of the AL spectrum at each frequency.

In the signal estimation sub-module 1320, the input spectrum and the noise estimation vector are used to estimate a signal-to-noise ratio of each frequency (hereinafter referred to as a SNR estimation vector), and a NR spectrum is obtained by adjusting the input spectrum according to the SNR estimation vector. If the AL spectrum is the input of the NR sub-module 1300, the noise estimation vector and the AL spectrum are used to estimate a SNR estimation vector, and a noise reduction loudness (hereinafter abbreviated as NRL) spectrum is obtained by adjusting the AL spectrum according to the SNR estimation vector. The signal processing of noise estimation, signal estimation and SNR estimation can be referred to reference document 2, where the design considerations, implementation details, and performance description of various kinds of NR processing for speech enhancement are introduced.

Figure 12:
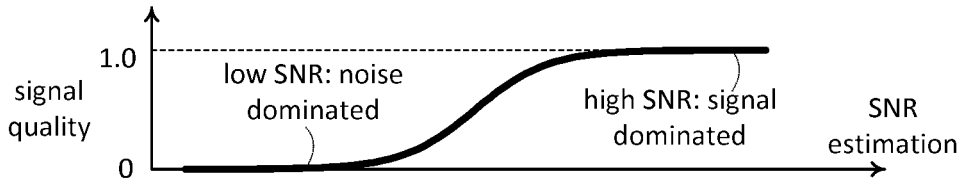
FIG. 12 is a graph of a monotonic function of the present invention.

The SQ estimation sub-module 1330 is used to convert the SNR estimation vector into a SQ vector (i.e. the signal quality estimation of each frequency) to provide the signal quality information required by the subsequent processing, such as the SS sub-module 250. The conversion, for example, is to pass each element of the SNR estimation vector through a monotonic function to obtain the SQ vector. The monotonic function shown in FIG. 12 is used to map the SNR of each frequency to the numerical range applicable by the subsequent processing stages.

In FIG. 10, the NR spectrum obtained from the NR sub-module 1300 is passed to the AL model 230 in place of the input spectrum obtained from the FWA unit 120 of FIG. 5. Referring to paragraphs [0044] to [0050], the AL spectrum is obtained with the AL model 230 by performing computations on the ATE profile and the NR spectrum.

In addition, the SQ vector obtained from the NR sub-module 1300 is passed to the SS sub-module 250. Referring to FIG. 7 and paragraphs [0051] to [0055], the modified spectrum and the LSG vector are obtained with the SS sub-module 250 by performing computations on the input spectrum, the SQ vector, the AL spectrum obtained from the AL model 230, and the BL spectrum obtained from the BL model 240.

Figure 13:
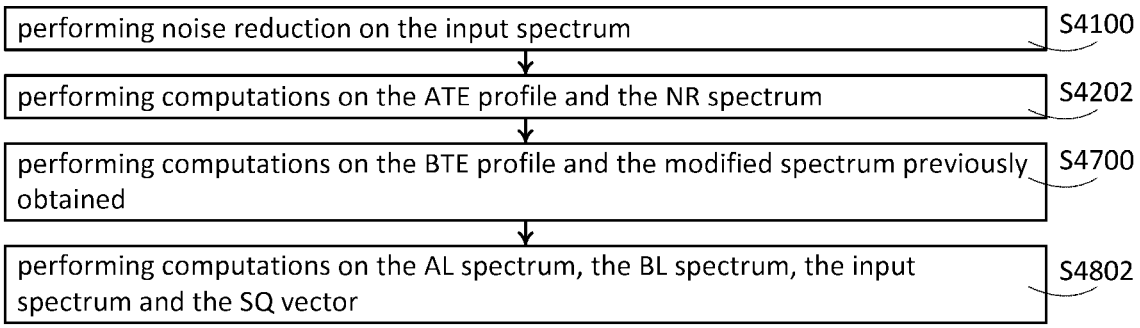
FIG. 13 is a flowchart of a first variant of the JSGA method of the present invention.

FIG. 13 is the flowchart of the first variant of the JSGA method of the present invention. The flow of the JSGA method of FIG. 13 is different from that of FIG. 8 in three flow steps. Referring to paragraphs [0072] to [0075], a NR spectrum and a SQ vector are obtained by performing NR processing on the input spectrum obtained from the FWA unit 120 with the NR sub-module 1300. The NR spectrum is passed to the AL model 230. The SQ vector is passed to the SS sub-module 250 (step S4100).

Referring to paragraphs [0032] to [0035], [0044] to [0050], the AL spectrum is obtained with the AL model 230 by performing computations on the ATE profile obtained by the fitting procedure 210 and the NR spectrum obtained from the NR sub-module 1300 (step S4202). Since step S4700 of FIG. 13 is identical to step S4700 of FIG. 8, the corresponding description will be omitted. Further, because of no data dependency between step S4700 and consecutive steps S4100 and S4202, step S4700 can also be executed before, between, or in parallel with the two steps without changing computation results. FIG. 13 just shows a possible flow.

Referring to paragraphs [0051] to [0055], the modified spectrum and the LSG vector are obtained with the SS sub-module 250 by performing computations on the input spectrum, the AL spectrum obtained from the AL model 230, the BL spectrum obtained from the BL model 240, and the SQ vector obtained from the NR sub-module 1300 (step S4802).

Figure 14:
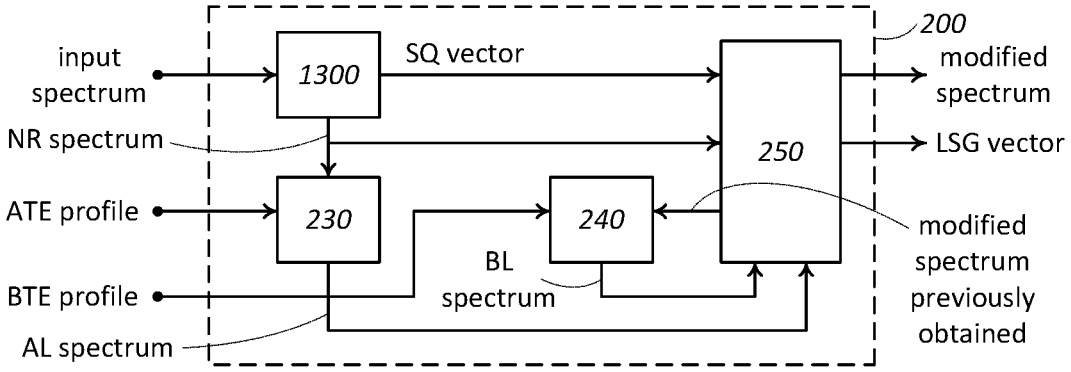
FIG. 14 is a block diagram of a second variant of the JSGA module of the present invention.

FIG. 14 is the block diagram of the second variant of the JSGA module of the present invention. As compared to the structure of the JSGA module 200 of FIG. 10, the NR spectrum obtained from the NR sub-module 1300 of the JSGA module 200 of FIG. 14 is passed to the SS sub-module 250 in place of the input spectrum obtained from the FWA unit 120.

Referring to FIG. 7 and paragraphs [0051] to [0055], the modified spectrum and the LSG vector are obtained with the SS sub-module 250 by performing computations on the NR spectrum and the SQ vector obtained from the NR sub-module 1300, the AL spectrum obtained from the AL model 230, and the BL spectrum obtained from the BL model 240.

Figure 15:
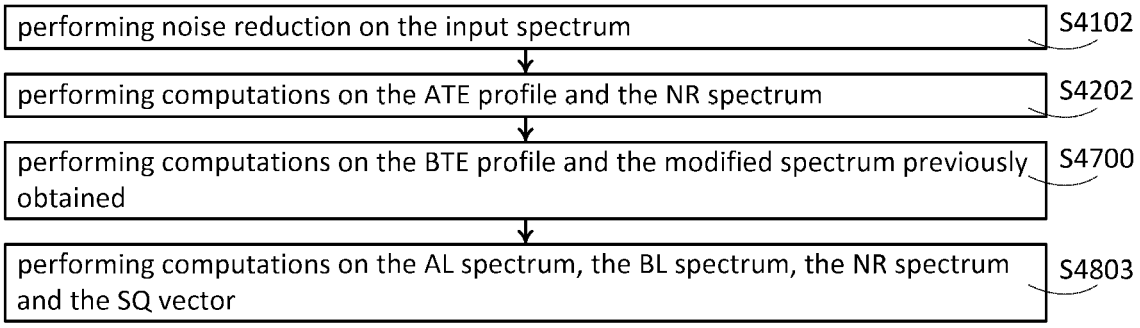
FIG. 15 is a flowchart of a second variant of the JSGA method of the present invention.

FIG. 15 is the flowchart of the second variant of the JSGA method of the present invention. The flow of the JSGA method of FIG. 15 is different from that of FIG. 13 in two flow steps. A NR spectrum and a SQ vector are obtained by performing NR processing on the input spectrum obtained from the FWA unit 120 with the NR sub-module 1300. The NR spectrum is passed to the AL model 230. The NR spectrum and the SQ vector are passed to the SS sub-module 250 (step S4102).

Referring to paragraphs [0051] to [0055], the modified spectrum and the LSG vector are obtained with the SS sub-module 250 by performing computations on the NR spectrum and the SQ vector obtained from the NR sub-module 1300, the AL spectrum obtained from the AL model 230, and the BL spectrum obtained from the BL model 240 (step S4803). Since steps S4202 and S4700 of FIG. 15 are identical to steps S4202 and S4700 of FIG. 13, the corresponding step descriptions are omitted. Further, because of no data dependency between step S4700 and consecutive steps S4102 and S4202, step S4700 can also be executed before, between, or in parallel with the two steps without changing computation results. FIG. 15 just shows a possible flow.

Figure 16:
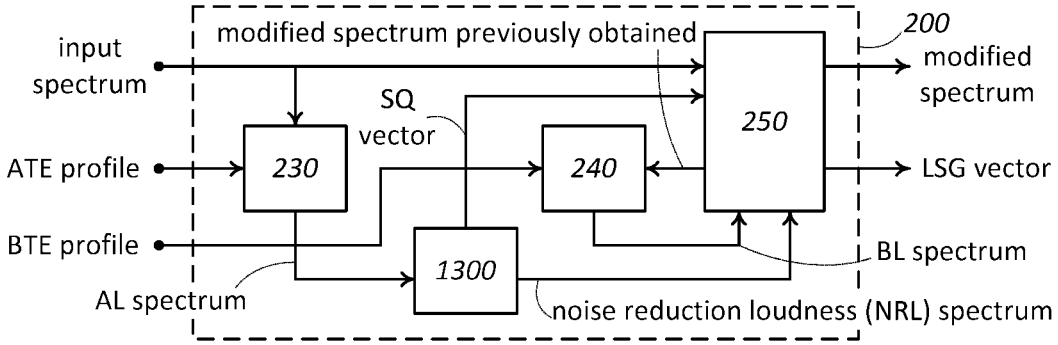
FIG. 16 is a block diagram of a third variant of the JSGA module of the present invention.

FIG. 16 is the block diagram of the third variant of the JSGA module of the present invention. As compared to the structure of the JSGA module 200 of FIG. 5, the JSGA module 200 of FIG. 16 further comprises a NR sub-module 1300.

Owing to the high statistical correlation and identical value range between loudness spectra and the amplitude of acoustic spectra (positive values or zeros), frequency-domain NR processing performed on the amplitude of acoustic spectra can be performed on the loudness spectra, whereas different sound effects are provided. Performing NR processing on loudness spectra associates the NR processing with the hearing model of the listener which produces an effect similar to the perceptual-based NR processing in reference document 2 operating on the acoustic spectrum domain. Nonetheless, since the information of the input sound is partially lost, the loudness spectra are not suitable for directly reconstructing the waveform. In the variant of the JSGA module of the present invention, the NRL spectrum is passed to the spectral shaping sub-module 250, thereby feeding the noise reduced information back to adjust the spectral gain so that the NR processing is performed in an indirect way.

The AL spectrum obtained from the AL model 230 is passed to the NR sub-module 1300 in place of the input spectrum obtained from the FWA unit 120 of FIG. 11. Referring to FIG. 11 and paragraphs [0072] to [0075], a NRL spectrum and a SQ vector of monaural type are obtained with the NR sub-module 1300 by performing NR processing on the AL spectrum. In a binaural system or application, a NRL spectrum and a SQ vector of binaural type are obtained with the NR sub-module 1300 by performing NR processing on the left-ear AL spectrum and the right-ear AL spectrum of the AL spectrum obtained from the AL model 230 separately.

The NRL spectrum becomes the input of the SS sub-module 250 in place of the AL spectrum of FIG. 5. Referring to FIG. 7 and paragraphs [0051] to [0055], the modified spectrum and the LSG vector are obtained with the SS sub-module 250 by performing computations on the input spectrum obtained from the FWA unit 120, the NRL spectrum and the SQ vector obtained from the NR sub-module 1300, and the BL spectrum obtained from the BL model 240.

Figure 17:
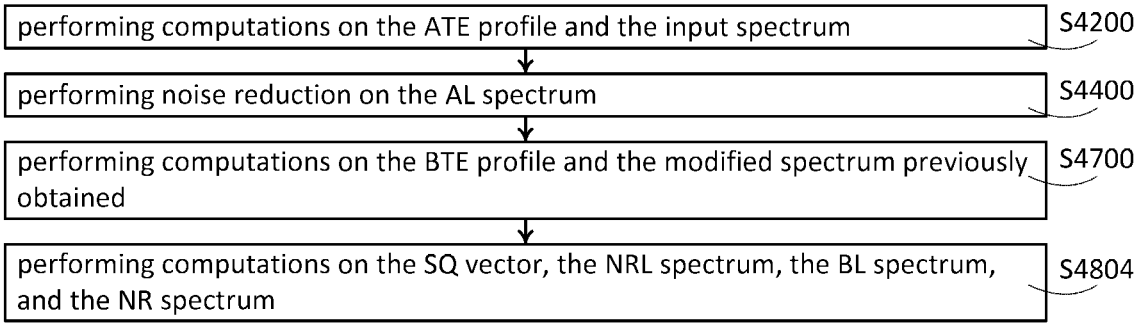
FIG. 17 is a flowchart of a third variant of the JSGA method of the present invention.

FIG. 17 is the flowchart of the third variant of the JSGA method of the present invention. The flow of the JSGA method of FIG. 17 is different from that of FIG. 8 in two flow steps. Referring to paragraphs [0072] to [0075], a SQ vector and a NRL spectrum are obtained by performing NR processing on the AL spectrum obtained from the AL model 230 with the NR sub-module 1300. The SQ vector and the NRL spectrum are passed to the SS sub-module 250 (step S4400).

Referring to paragraphs [0051] to [0055], the modified spectrum and the LSG vector are obtained with the SS sub-module 250 by performing computations on the SQ vector and the NRL spectrum obtained from the NR sub-module 1300, the BL spectrum obtained from the BL model 240, and the input spectrum (step S4804). Since steps S4200 and S4700 of FIG. 17 are identical to steps S4200 and step S4700 of FIG. 8, the corresponding step descriptions are omitted. Further, because of no data dependency between step S4700 and consecutive steps S4200 and S4400, step S4700 can also be executed before, between, or in parallel with the two steps without changing computation results. FIG. 17 just shows a possible flow.

Figure 18:
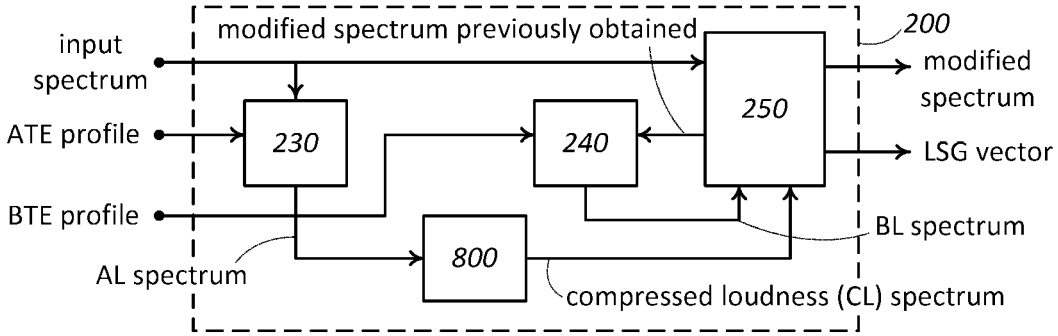
FIG. 18 is a block diagram of a fourth variant of the JSGA module of the present invention.

FIG. 18 is the block diagram of the fourth variant of the JSGA module of the present invention. As compared to the structure of the JSGA module 200 of FIG. 5, the JSGA module 200 of FIG. 18 further comprises a loudness spectrum compression sub-module 800, wherein a compressed loudness (hereinafter abbreviated as CL) spectrum of monaural type is obtained by performing DRC processing on the AL spectrum corresponding to a channel or each of a plurality of channels separately.

The meaning and effect of performing DRC processing on a loudness spectrum (also referred to as loudness spectrum compression) are different from that of performing DRC processing on an acoustic spectrum. In the JSGA module of the present invention, since the listener's hearing loss and the noise issues have been dealt with by the aforementioned sub-modules, the compression characteristics used in the loudness spectrum compression sub-module 800 can be configured according to listener's preference rather than hearing loss condition, thus the single-channel loudness spectrum compression is applicable even for listeners with large difference on the amounts of threshold elevation across frequencies.

The present invention argues that, in a binaural system or application, the audio processing has better to keep the loudness ratio between the two ears at each channel unchanged to reduce the impact to the binaural sound localization or related functions. Based on this argument, a CL spectrum of binaural type is obtained with the loudness spectrum compression sub-module 800 by performing DRC processing on the left-ear AL spectrum and the right-ear AL spectrum of the AL spectrum in the same way, that is, the loudness spectra corresponding to two ears in the frequency range of each channel are both scaled by a value referred to as channel loudness gain.

Figure 19:
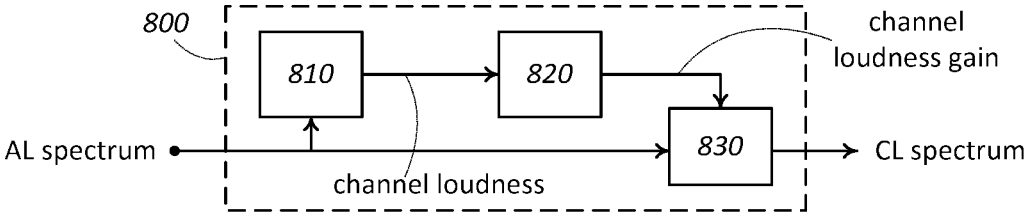
FIG. 19 is a block diagram of a loudness spectrum compression sub-module of the present invention.

FIG. 19 is the block diagram of the loudness spectrum compression sub-module of the present invention, wherein the loudness spectrum compression sub-module 800 comprises a channel loudness calculation sub-module 810, a compression characteristic substitution sub-module 820, and a loudness spectrum scaling sub-module 830.

The channel loudness calculation sub-module 810 is used to obtain a channel loudness corresponding to the channel or each of the plurality of the channels by performing integration on the AL spectrum over the channel frequency range (since the loudness spectrum is represented by finite elements, the integration is represented as a summation):

$$L_{CH}=\Sigma_{z=z_{CH_L}(CH)}^{z_{CH_U}(CH)}L_{AIDED}(z)\cdot\Delta_z \tag{13}$$

where CH denotes the channel index corresponding to the channel frequency between $z_{CH_L}(CH)$ and $z_{CH_U}(CH)$, $L_{AIDED}(z)$ and $\Delta_z$ denote the values of the AL spectrum and the reciprocal of the number of the loudness spectrum elements per unit frequency at frequency z, respectively. In a binaural system or application, the channel loudness is calculated as:

$$L_{CH}=\Sigma_{z=z_{CH_L}(CH)}^{z_{CH_U}(CH)}(L_{AIDED}(z)+L_{AIDED,R}(z))\cdot\Delta_z \tag{13}$$

where $L_{AIDED,L}(z)$ and $L_{AIDED,R}(z)$ denote the values of the left-ear AL spectrum and the right-ear AL spectrum of the AL spectrum at the frequency z, respectively, and other notations are as aforementioned.

Figure 20:
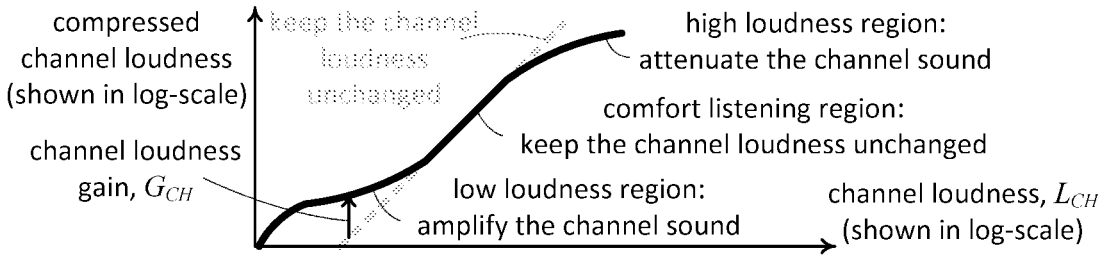
FIG. 20 is a graph of a typical input-output mapping function for loudness spectrum compression of the present invention.

The compression characteristic substitution sub-module 820 is used to obtain a channel loudness gain $G_{CH}$ corresponding to the channel or each of the plurality of channels, which is the ratio between the compressed channel loudness and the original channel loudness $L_{CH}$ corresponding to the channel or each of the plurality of channels, by substituting the channel loudness $L_{CH}$ corresponding to the channel or each of the plurality of channels into the channel compression characteristics corresponding to the channel or each of the plurality of channels. A channel compression characteristic shown in FIG. 20 is aimed to amplify the low loudness sound (weak signal) and to attenuate the high loudness sound. In a binaural system or application, this sub-module operates in the same way as in a monaural system or application.

The loudness spectrum scaling sub-module 830 is used to obtain a CL spectrum by scaling the AL spectrum with the channel loudness gain corresponding to the channel or each of the plurality of channels in the corresponding frequency range:

$$L_{CMP}(z)=L_{AIDED}(z)\cdot G_{CH}\cdot z_{CH_L}(CH)\le z\le z_{CH_U}(CH) \tag{15}$$

where $L_{CMP}(z)$ denotes the value of the CL spectrum at the frequency z, and other notations are as aforementioned. In a binaural system or application, the CL spectrum is calculated as:

$$\begin{cases} L_{CMP,L}(z)=L_{AIDED,L}(z)\cdot G_{CH} \\ L_{CMP,R}(z)=L_{AIDED,R}(z)\cdot G_{CH} \end{cases} \forall\, z_{CH_L}(CH)\le z\le z_{CH_U}(CH) \tag{16}$$

where $L_{CMP,L}(z)$ and $L_{CMP,R}(z)$ denote the values of the left-ear CL spectrum and the right-ear CL spectrum of the CL spectrum at frequency z, respectively, and other notations are as aforementioned.

The CL spectrum is passed to the SS sub-module 250 in place of the AL spectrum obtained from the AL model 230 of FIG. 5. Referring to FIG. 7 and paragraphs [0051] to [0055], the modified spectrum and the LSG vector are obtained with the SS sub-module 250 by performing computations on the input spectrum obtained from the FWA unit 120, the CL spectrum, and the BL spectrum obtained from the BL model 240.

Figure 21:
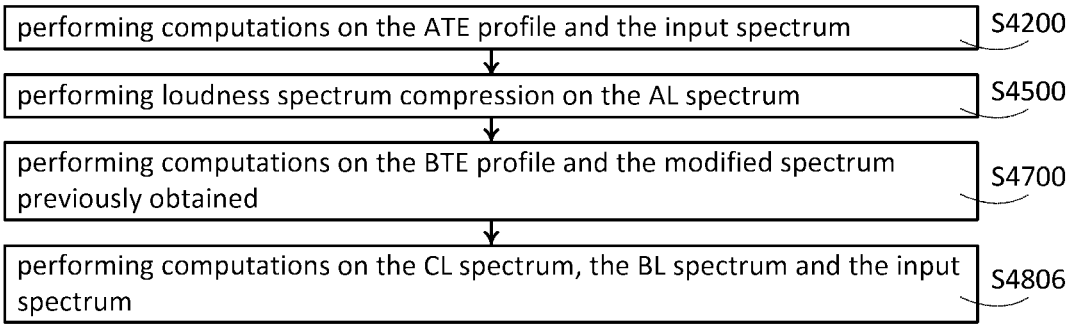
FIG. 21 is a flowchart of a fourth variant of the JSGA method of the present invention.

FIG. 21 is the flowchart of the fourth variant of the JSGA method of the present invention. The flow of the JSGA method of FIG. 21 is different from that of FIG. 8 in two flow steps. Referring to paragraphs [0094] to [0097], a CL spectrum is obtained with the loudness spectrum compression sub-module 800 by performing loudness spectrum compression on the AL spectrum obtained from the AL model 230 corresponding to a channel or each of a plurality of channels separately. The CL spectrum is passed to the SS sub-module 250 (step S4500).

Referring to paragraphs [0051] to [0055], the modified spectrum and the LSG vector are obtained with the SS sub-module 250 by performing computations on the CL spectrum obtained from the loudness spectrum compression sub-module 800, the input spectrum, and the BL spectrum obtained from the BL model 240 (step S4806). Since steps S4200 and S4700 of FIG. 21 are identical to steps S4200 and S4700 of FIG. 8, the corresponding step descriptions are omitted. Further, because of no data dependency between step S4700 and consecutive steps S4200 and S4500, step S4700 can also be executed before, between, or in parallel with the two steps without changing computation results. FIG. 21 just shows a possible flow.

Figure 22:
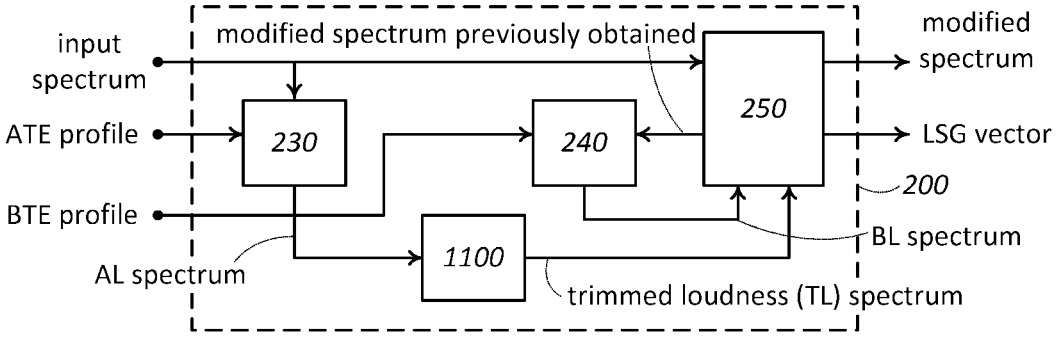
FIG. 22 is a block diagram of a fifth variant of the JSGA module of the present invention.

FIG. 22 is the block diagram of the fifth variant of the JSGA module of the present invention. As compared to the structure of the JSGA module 200 of FIG. 5, the JSGA module 200 of FIG. 22 further comprises an attack trimming sub-module 1100.

Transient sounds are sounds that have dramatic volume changes in time domain, such as airs or consonants in speech, burst noise and interference sound in the living environment, and sounds introduced in audio processing. An example of the latter is that an effect of combined NR and DRC processing is to make part of the sound more prominent, since the dynamic range of the sound is increased by the NR processing, while the noise reduced sound is adjusted by subsequent dynamic range compression according to the average volume of it. At the moment of the sound suddenly appearing from a lower volume (e.g. denoise) background, the dynamic range compression keeps providing a gain for the lower volume background which makes the sound louder and even causes discomfort to the listener.

On the other hand, transient sounds such as percussion and blasting sounds may be related to safety. Hence detecting and removing transient sounds is not a widely applicable strategy. Different from the conventional transient sound processing on the sound waveform or its spectrum, the present invention proposes to reduce the total loudness of the sound to barely avoid listening discomfort by proportionally adjusting elements of the AL spectrum. Such processing is referred to as attack trimming (hereinafter abbreviated as AT).

The AT sub-module 1100 is used to obtain a trimmed loudness (hereinafter abbreviated as TL) spectrum of monaural type by performing AT processing on the AL spectrum obtained from the AL model 230. In a binaural system or application, the AT sub-module 1100 is used to obtain a TL spectrum of binaural type by performing AT processing on both the left-ear AL spectrum and the right-ear AL spectrum of the AL spectrum.

Figure 23:
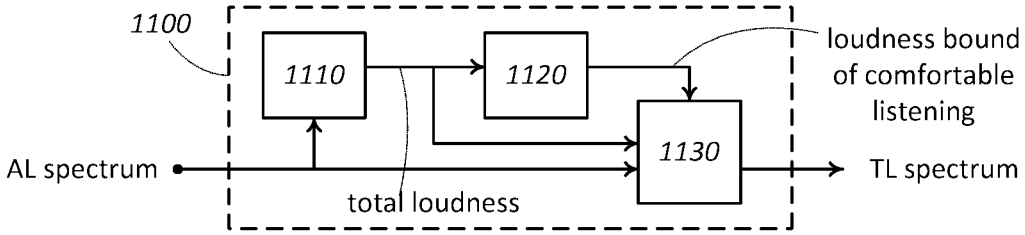
FIG. 23 is a block diagram of an attack trimming sub-module of the present invention.

FIG. 23 is the block diagram of the AT sub-module of the present invention, wherein the AT sub-module 1100 comprises a total loudness calculation sub-module 1110, a loudness upper-bound estimation sub-module 1120, and a loudness limiting sub-module 1130.

The total loudness calculation sub-module 1110 is used to obtain a total loudness $L_{TOTAL}$ by performing integration on the AL spectrum over frequency:

$$L_{TOTAL}=\Sigma_z L_{AIDED}(z)\cdot\Delta_z \tag{17}$$

where $L_{AIDED}(z)$ and $\Delta_z$ denote the values of the AL spectrum and the reciprocal of the number of the AL spectrum elements per unit frequency at frequency z, respectively. In a binaural system or application, the total loudness is calculated as:

$$L_{TOTAL}=\Sigma_z(L_{AIDED,L}(z)+L_{AIDED,R}(z))\cdot\Delta_z \tag{18}$$

where $L_{AIDED,L}(z)$ and $L_{AIDED,R}(z)$ denote the values of the left-ear AL spectrum and the right-ear AL spectrum of the AL spectrum at the frequency z, respectively, and other notations are as aforementioned.

The loudness upper-bound estimation sub-module 1120 is used to derive a loudness bound of comfortable listening $L_{BOUND}$ according to the total loudness obtained from the total loudness calculation sub-module 1110, for example, by performing time smoothing on the total loudness to obtain a long-term loudness $LL_m$ of the present frame period m, and deriving the loudness bound of comfortable listening according to the long-term loudness:

$$LL_m=\begin{cases} LL_{m-1}+(L_{TOTAL}-LL_{m-1})\cdot C_{ATT,LL} & \text{if } L_{TOTAL}\geq LL_{m-1} \\ LL_{m-1}+(L_{TOTAL}-LL_{m-1})\cdot C_{REL,LL} & \text{if } L_{TOTAL}<LL_{m-1} \end{cases} \tag{19}$$

$$L_{BOUND}=\min\{LL_m\cdot C_{HEADROOM}.L_{UCL}\} \tag{20}$$

where $LL_{m-1}$ denotes the long-term loudness of the previous frame period m−1, $C_{ATT,LL}$ and $C_{REL,LL}$ denote the leaky factors of the smoothing operation on the rising and falling of the long-term loudness, respectively, $C_{HEADROOM}$ denotes the instantaneous loudness rising ratio acceptable by the listener, $L_{UCL}$ denotes the setting of a loudness value that makes the listener feel very loud, and other notations are as aforementioned. In a binaural system or application, this sub-module operates in the same way as in a monaural system or application.

The loudness limiting sub-module 1130 is used to derive a rate according to the total loudness obtained from the total loudness calculation sub-module 1110 and the loudness bound of comfortable listening obtained from the loudness upper-bound estimation sub-module 1120, and to obtain a TL spectrum by scaling down the AL spectrum with the rate:

$$L_{TRIM}(z)=L_{AIDED}(z)\cdot\min\left\{\frac{L_{BOUND}}{L_{TOTAL}},1\right\}\forall z \tag{21}$$

where $L_{TRIM}(z)$ denotes the value of the TL spectrum at the frequency z, and other notations are as aforementioned. In a binaural system or application, the TL spectrum is calculated as:

$$\begin{cases} L_{TRIM,L}(z)=L_{AIDED,L}(z)\cdot\min\left\{\frac{L_{BOUND}}{L_{TOTAL}},1\right\} \\ L_{TRIM,R}(z)=L_{AIDED,R}(z)\cdot\min\left\{\frac{L_{BOUND}}{L_{TOTAL}},1\right\} \end{cases}\forall z \tag{22}$$

where $L_{TRIM,L}(z)$ and $L_{TRIM,R}(z)$ denote the values of the left-ear TL spectrum and the right-ear TL spectrum of the TL spectrum at frequency z, respectively, and other notations are as aforementioned.

The TL spectrum is passed to the SS sub-module 250 in place of the AL spectrum of FIG. 5. Referring to FIG. 7 and paragraphs [0051] to [0055], the modified spectrum previously obtained from the SS sub-module 250 is passed to the BL model 240, and the modified spectrum and the LSG vector are obtained with the SS sub-module 250 by performing computations on the input spectrum obtained from the FWA unit 120, the TL spectrum, and the BL spectrum obtained from the BL model 240.

Figure 24:
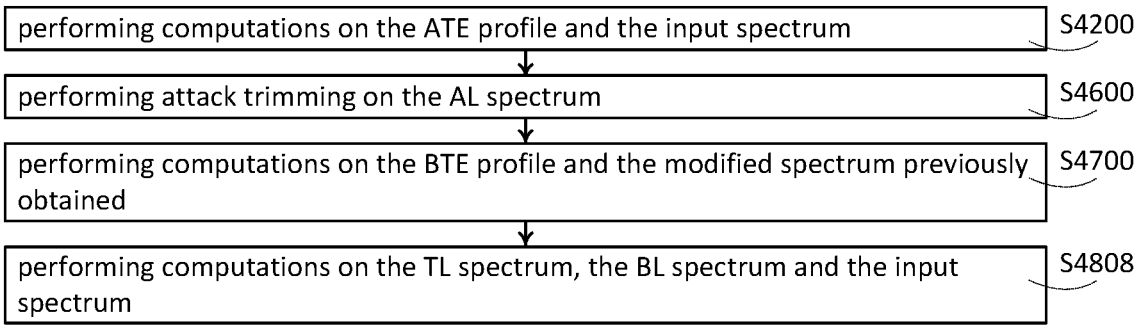
FIG. 24 is a flowchart of a fifth variant of the JSGA method of the present invention.

FIG. 24 is the flowchart of the fifth variant of the JSGA method of the present invention. The flow of the JSGA method of FIG. 24 is different from that of FIG. 8 in two flow steps. Referring to paragraphs [0105] to [0108], a TL spectrum is obtained by performing AT processing on the AL spectrum obtained from the AL model 230 with the AT sub-module 1100. The TL spectrum is passed to the SS sub-module 250 (step S4600).

Referring to paragraphs [0051] to [0055], the LSG vector and the modified spectrum are obtained with the SS sub-module 250 by performing computations on the TL spectrum obtained from the AT sub-module 1100, the BL spectrum obtained from the BL model 240, and the input spectrum (step S4808). Since steps S4200 and S4700 of FIG. 24 are identical to steps S4200 and S4700 of FIG. 8, the corresponding step descriptions are omitted. Further, because of no data dependency between step S4700 and consecutive steps S4200 and S4600, step S4700 can also be executed before, between, or in parallel with the two steps without changing computation results. FIG. 24 just shows a possible flow.

Figure 25:
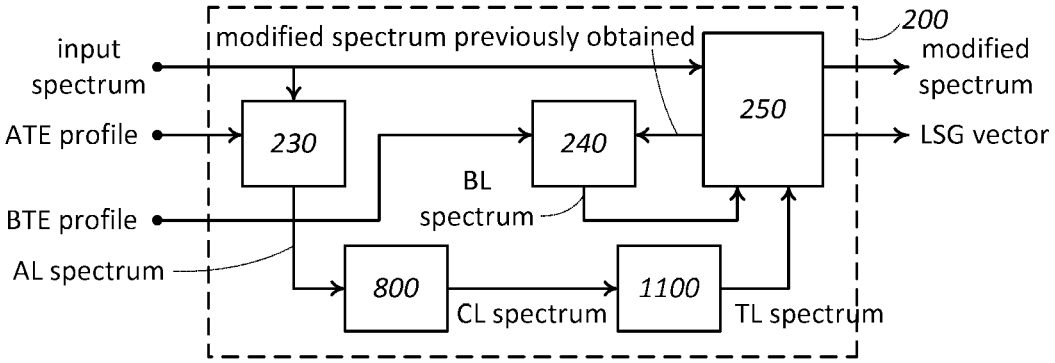
FIG. 25 is a block diagram of a sixth variant of the JSGA module of the present invention.

FIG. 25 is the block diagram of the sixth variant of the JSGA module of the present invention. As compared to the structure of the JSGA module 200 of FIG. 18, the JSGA module 200 of FIG. 25 further comprises an AT sub-module 1100.

The CL spectrum obtained from the loudness spectrum compression sub-module 800 of FIG. 25 becomes the input of the AT sub-module 1100 in place of the AL spectrum obtained from the AL model 230 of FIG. 23. Referring to FIG. 23 and paragraphs [0105] to [0108], a TL spectrum is obtained by performing AT processing on the CL spectrum with the AT sub-module 1100.

The TL spectrum obtained from the AT sub-module 1100 of FIG. 25 becomes the input of the SS sub-module 250 in place of the CL spectrum obtained from the loudness spectrum compression sub-module 800 of FIG. 18. Referring to FIG. 7 and paragraphs [0051] to [0055], the modified spectrum and the LSG vector are obtained with the SS sub-module 250 by performing computations on the input spectrum obtained from the FWA unit 120, the TL spectrum, and the BL spectrum obtained from the BL model 240.

Figure 26:
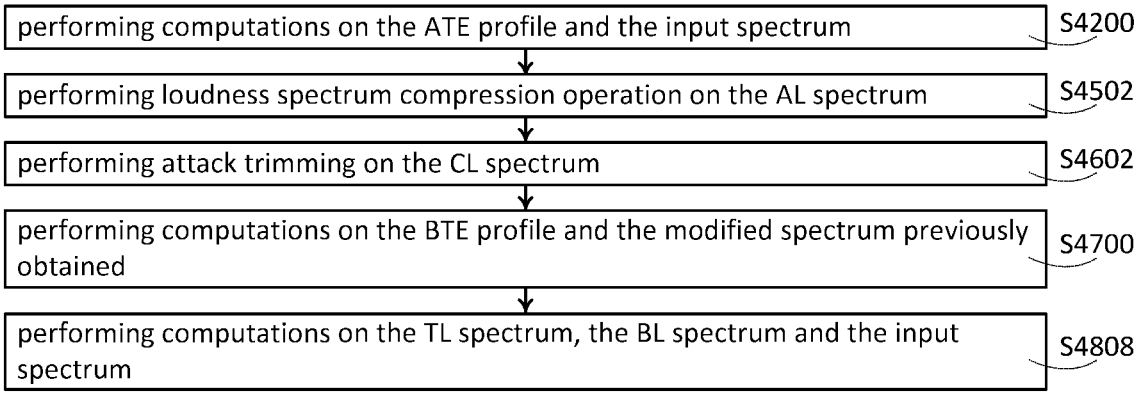
FIG. 26 is a flowchart of a sixth variant of the JSGA method of the present invention.

FIG. 26 is the flowchart of the sixth variant of the JSGA method of the present invention. The flow of the JSGA method of FIG. 26 is different from that of FIG. 21 in three flow steps. Referring to paragraphs [0094] to [0097], the CL spectrum is obtained by performing loudness spectrum compression on the AL spectrum obtained from the AL model 230 with the loudness spectrum compression sub-module 800. The CL spectrum is passed to the AT sub-module 1100 (step S4502).

Referring to paragraphs [0105] to [0108], a TL spectrum is obtained by performing AT processing on the CL spectrum obtained from the loudness spectrum compression sub-module 800 with the AT sub-module 1100. The TL spectrum is passed to the SS sub-module 250 (step S4602). Referring to paragraphs [0051] to [0055], the LSG vector and the modified spectrum are obtained with the SS sub-module 250 by performing computations on the TL spectrum obtained from the AT sub-module 1100, the BL spectrum obtained from the BL model 240, and the input spectrum (step S4808). Since steps S4200 and S4700 of FIG. 26 are identical to steps S4200 and S4700 of FIG. 21, the corresponding step descriptions are omitted. Further, because of no data dependency between step S4700 and consecutive steps S4200, S4502, and S4602, step S4700 can also be executed before, between, or in parallel with the three steps without changing computation results. FIG. 26 just shows a possible flow.

Generally speaking, the frequency-domain NR processing is suitable for suppressing steady noise in speech rather than transient-type noise in speech. As the DRC processing is performed after NR processing, the interaction of them makes the transient-type noise in speech become prominent. The following variants of the JSGA module 200 of the present invention further integrates a NR sub-module 1300, a loudness spectrum compression sub-module 800, and an AT sub-module 1100. It is with the purpose of limiting the amount of instantaneous changes on loudness while performing both the NR processing and the DRC processing to improve the sound quality felt by the listener through reducing the interaction of the algorithms.

Figure 27:
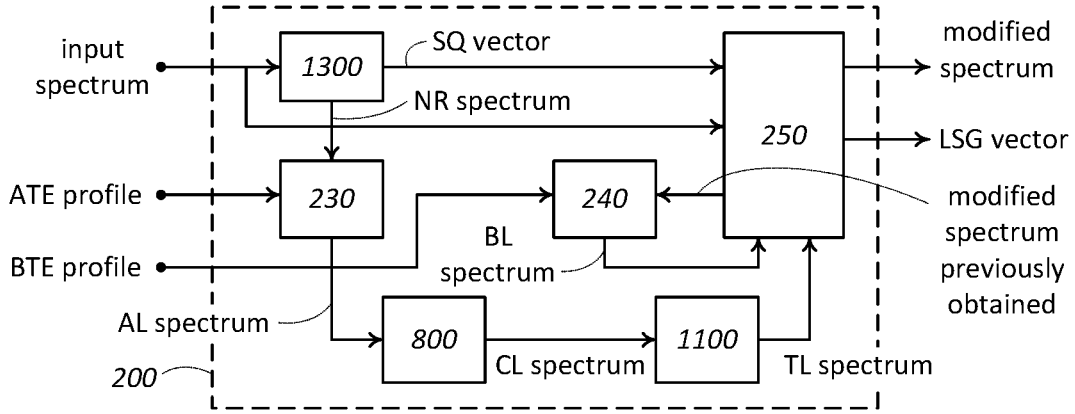
FIG. 27 is a block diagram of a seventh variant of the JSGA module of the present invention.

FIG. 27 is the block diagram of the seventh variant of the JSGA module of the present invention. As compared to the structure of the JSGA module 200 of FIG. 25, the JSGA module 200 of FIG. 27 further comprises a NR sub-module 1300.

Referring to paragraphs [0072] to [0075], a NR spectrum and a SQ vector are obtained by performing NR processing on the input spectrum obtained from the FWA unit 120 with the NR sub-module 1300. The NR spectrum is passed to the AL model 230. The SQ vector is passed to the SS sub-module 250. Referring to paragraphs [0044] to [0050], the AL spectrum is obtained with the AL model 230 by performs computations on the ATE profile and the NR spectrum.

The TL spectrum obtained from the AT sub-module 1100 of FIG. 27 is passed to the SS sub-module 250 in place of the AL spectrum obtained from the AL model 230. Referring to FIG. 7 and paragraphs [0051] to [0055], the modified spectrum and the LSG vector are obtained with the SS sub-module 250 by performing computations on the input spectrum, the SQ vector, the TL spectrum, and the BL spectrum.

Figure 28:
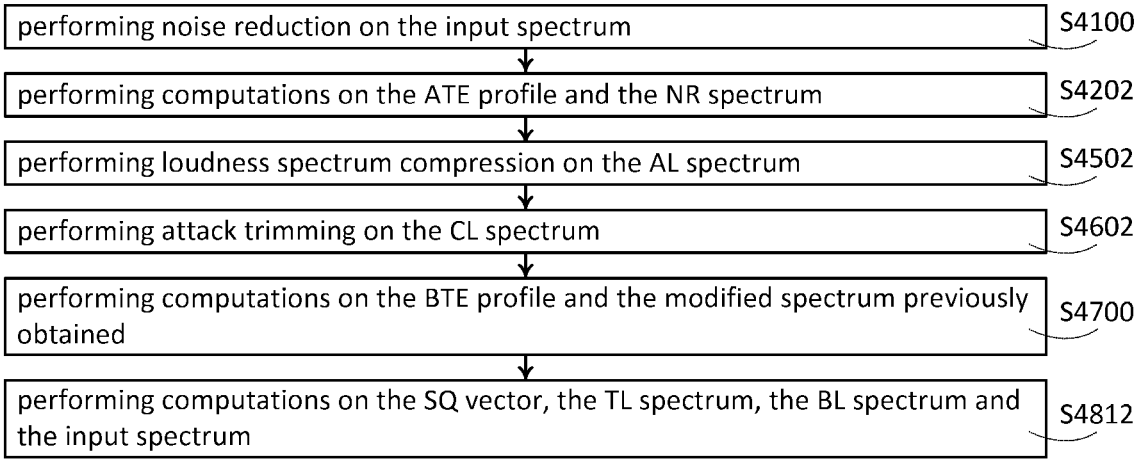
FIG. 28 is a flowchart of a seventh variant of the JSGA method of the present invention.

FIG. 28 is the flowchart of the seventh variant of the JSGA method of the present invention. The flow of the JSGA method of FIG. 28 is different from that of FIG. 26 in three flow steps. Referring to paragraphs [0072] to [0075], a NR spectrum and a SQ vector are obtained by performing NR processing on the input spectrum obtained from the FWA unit 120 (see FIG. 3) with the NR sub-module 1300. The NR spectrum is passed to the AL model 230. The SQ vector is passed to the SS sub-module 250 (step S4100).

Referring to paragraphs [0032] to [0035], [0044] to [0050], the AL spectrum is obtained with the AL model 230 by performing computations on the ATE profile obtained by the fitting procedure 210 and the NR spectrum obtained from the NR sub-module 1300 (step S4202).

Referring to paragraphs [0051] to [0055], the LSG vector and the modified spectrum are obtained with the SS sub-module 250 by performing computations on the SQ vector, the TL spectrum, the BL spectrum, and the input spectrum (step S4812). Since steps S4700, S4502, and S4602 of FIG. 28 are identical to steps S4700, S4502, and S4602 of FIG. 26, the corresponding step descriptions are omitted. Further, because of no data dependency between step S4700 and consecutive steps S4100, S4202, S4502, and S4602, step S4700 can also be executed before, between, or in parallel with the four steps without changing computation results. FIG. 28 just shows a possible flow.

Figure 29:
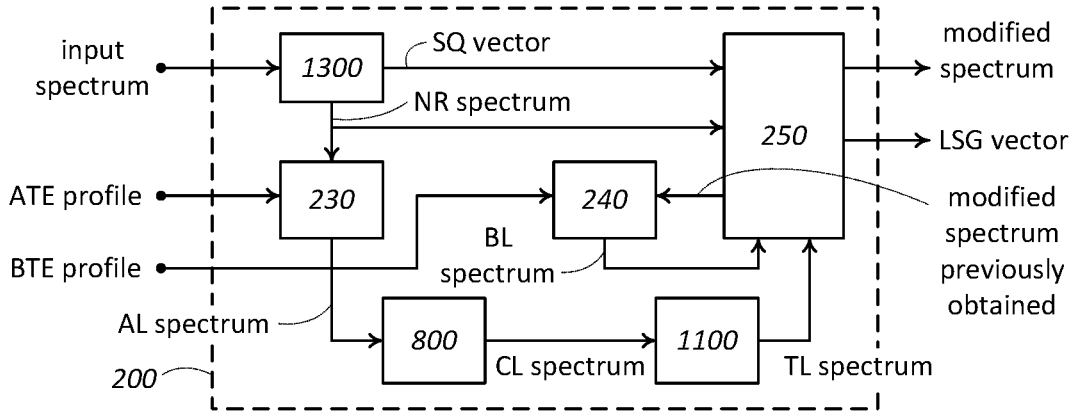
FIG. 29 is a block diagram of an eighth variant of the JSGA module of the present invention.

FIG. 29 is the block diagram of the eighth variant of the JSGA module of the present invention. As compared to the structure of the JSGA module 200 of FIG. 27, the NR spectrum obtained from the NR sub-module 1300 of the JSGA module 200 of FIG. 29 is passed to the SS sub-module 250 in place of the input spectrum obtained from the FWA unit 120.

Referring to FIG. 7 and paragraphs [0051] to [0055], the modified spectrum and the LSG vector are obtained with the SS sub-module 250 by performing computations on the NR spectrum, the SQ vector, the TL spectrum, and the BL spectrum.

Figure 30:
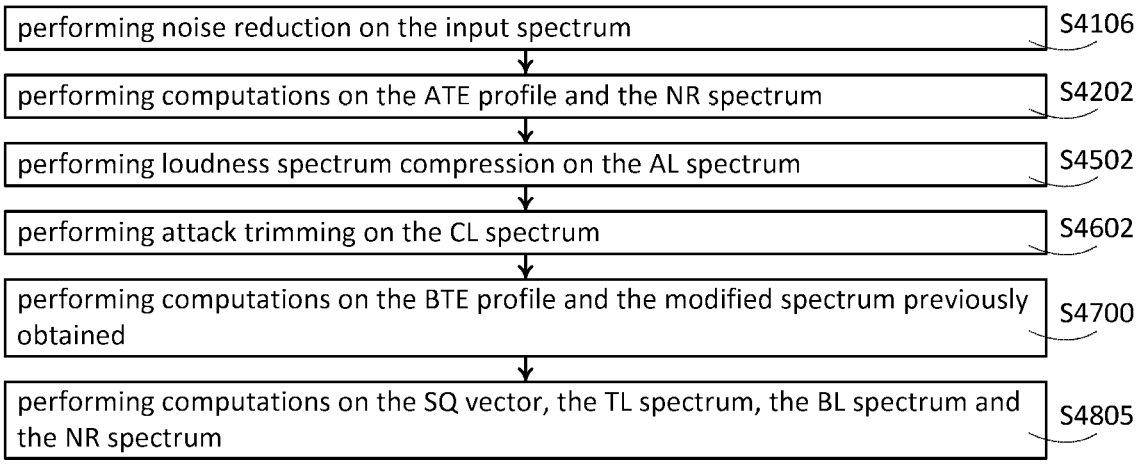
FIG. 30 is a flowchart of an eighth variant of the JSGA method of the present invention.

FIG. 30 is the flowchart of the eighth variant of the JSGA method of the present invention. The flow of the JSGA method of FIG. 30 is different from that of FIG. 28 in two flow steps. The NR spectrum obtained from the NR sub-module 1300 is passed to the AL model 230 and the SS sub-module 250 (step S4106).

Referring to paragraphs [0051] to [0055], the LSG vector and the modified spectrum are obtained with the SS sub-module 250 by performing computations on the NR spectrum, the SQ vector, the BL spectrum, and the TL spectrum (step S4805). Since steps S4202, S4700, S4502, and S4602 of FIG. 30 are identical to steps S4202, S4700, S4502, and S4602 of FIG. 28, the corresponding step descriptions are omitted. Further, because of no data dependency between step S4700 and consecutive steps S4106, S4202, S4502, and S4602, step S4700 can also be executed before, between, or in parallel with the four steps without changing computation results. FIG. 30 just shows a possible flow.

Figure 31:
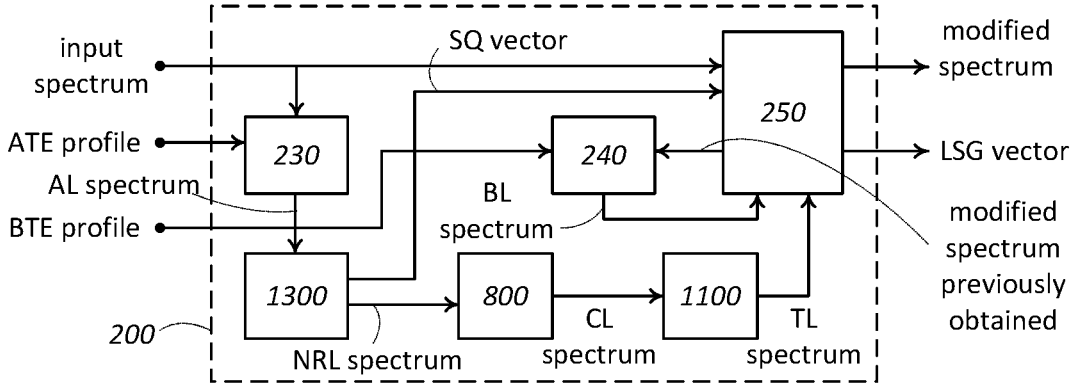
FIG. 31 is a block diagram of a ninth variant of the JSGA module of the present invention.

FIG. 31 is the block diagram of the ninth variant of the JSGA module of the present invention. As compared to the structure of the JSGA module 200 of FIG. 25, the JSGA module 200 of FIG. 31 further comprises a NR sub-module 1300.

The AL spectrum obtained from the AL model 230 is passed to the NR sub-module 1300. Referring to paragraphs [0072] to [0075], a NRL spectrum and a SQ vector are obtained by performing NR processing on the AL spectrum with the NR sub-module 1300. The NRL spectrum is passed to the loudness spectrum compression sub-module 800. The SQ vector is passed to the SS sub-module 250.

Referring to FIG. 19 and paragraphs [0094] to [0097], the CL spectrum is obtained by performing loudness spectrum compression on the NRL spectrum with the loudness spectrum compression sub-module 800.

Referring to FIG. 7 and paragraphs [0051] to [0055], the modified spectrum and the LSG vector are obtained with the SS sub-module 250 by performing computations on the input spectrum, the SQ vector, the TL spectrum, and the BL spectrum.

Figure 32:
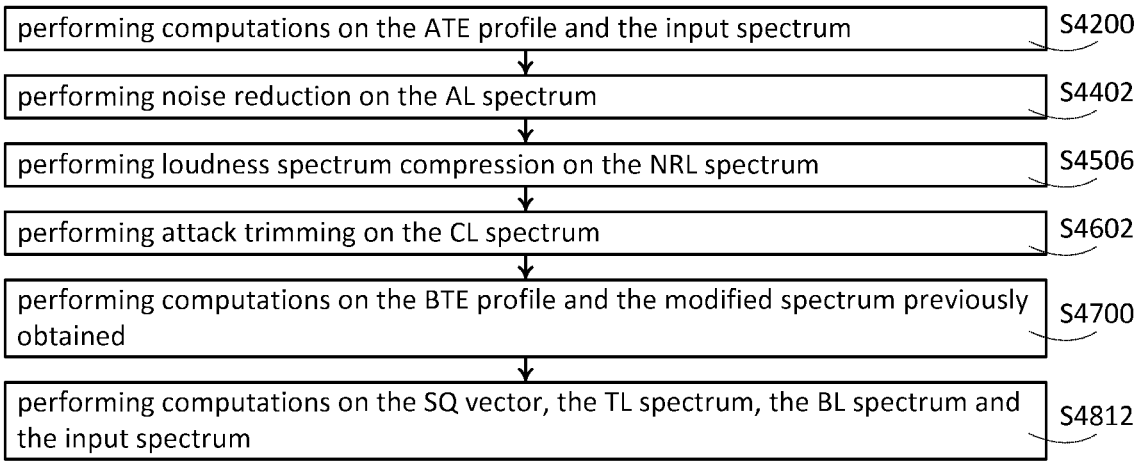
FIG. 32 is a flowchart of a ninth variant of the JSGA method of the present invention.

FIG. 32 is the flowchart of the ninth variant of the JSGA method of the present invention. The flow of the JSGA method of FIG. 32 is different from that of FIG. 26 in three flow steps. Referring to paragraphs [0072] to [0075], a NRL spectrum and a SQ vector are obtained by performing NR processing on the AL spectrum obtained from the AL model 230 with the NR sub-module 1300. The NRL spectrum is passed to the loudness spectrum compression sub-module 800. The SQ vector is passed to the SS sub-module 250 (step S4402).

Referring to paragraphs [0094] to [0097], the CL spectrum is obtained by performing loudness spectrum compression on the NRL spectrum with the loudness spectrum compression sub-module 800. The CL spectrum is passed to the AT sub-module 1100 (step S4506).

Referring to paragraphs [0051] to [0055], the LSG vector and the modified spectrum are obtained with the SS sub-module 250 by performing computations on the SQ vector, the TL spectrum, the BL spectrum, and the input spectrum (step S4812). Since steps S4200, S4700, and S4602 of FIG. 32 are identical to steps S4200, S4700, and S4602 of FIG. 26, the corresponding step descriptions are omitted. Further, because of no data dependency between step S4700 and consecutive steps S4200, S4402, S4506, and S4602, step S4700 can also be executed before, between, or in parallel with the four steps without changing computation results. FIG. 32 just shows a possible flow.

Figure 33:
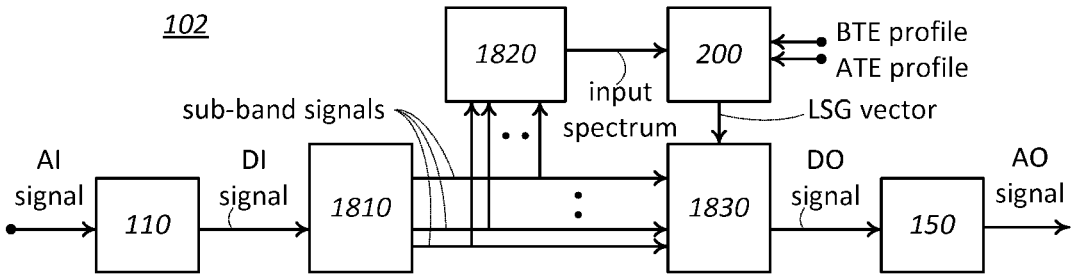
FIG. 33 is a block diagram of an audio processing system according to a second embodiment of the present invention.

FIG. 33 is the block diagram of the audio processing system according to the second embodiment of the present invention, wherein the audio processing system 102 comprises an ADC unit 110, an analysis filter bank 1810, a sub-band snapshot unit 1820, a JSGA module 200, a sub-band signal combining unit 1830, and a DAC unit 150.

The ADC unit 110 is used to obtain a DI signal by performing sampling on an AI signal at a time period. The AI signal and the DI signal are of monaural type. The time period is referred to as the sampling period.

The analysis filter bank 1810 is used to obtain a plurality of sub-band signals of monaural type by performing sub-band filtering on the DI signal obtained from the ADC unit 110, that is, passing the DI signal through each of a plurality of sub-band filters of the filter bank.

Figure 34:
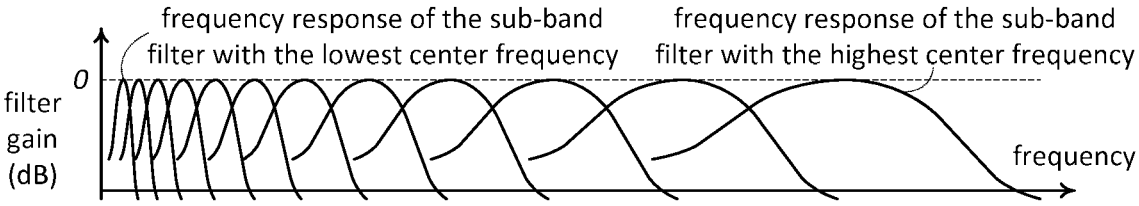
FIG. 34 is a frequency response plot of an analysis filter bank of the present invention.

The frequency responses of the sub-band filters of the analysis filter bank, as shown in FIG. 34, are typically with characteristics approximating the human auditory system such as unequally-spaced center frequencies, gradually-widening bandwidths toward higher center frequencies, and partially-overlapped frequency responses of adjacent sub-band filters. The design of the analysis filter bank applied in the audio processing can be referred to reference document 10.

The sub-band snapshot unit 1820 is used to obtain an input spectrum of each time interval by performing simultaneous sampling on each sub-band signal obtained from the analysis filter bank 1810 at a time interval and ranking simultaneously sampled values according to their corresponding sub-band center frequencies. The input spectrum and simultaneously sampled values are of monaural type.

Referring to block diagrams and related descriptions of the JSGA module and its variants of FIG. 5 to FIG. 31, the JSGA module 200 is used to obtain a LSG vector and a modified spectrum (not shown in FIG. 33 and only used inside the JSGA module 200 in this embodiment) by performing computations on an ATE profile, a BTE profile, and the input spectrum of each time interval obtained from the sub-band snapshot unit 1820. The ATE profile, the BTE profile, the LSG vector, and the modified spectrum are of monaural type.

The sub-band signal combining unit 1830 is used to obtain a DO signal of monaural type by performing weighted combining on the sub-band signals obtained from the analysis filter bank 1810 according to the LSG vector corresponding to each sampling period:

$$y(n) = \sum_{k=1}^{F} G_{JSGA}(n, k) \cdot x_k(n) \tag{23}$$

where n denotes the index of the sampling period, F denotes the number of sub-bands of the filter bank, y(n) and $x_k(n)$ denote the DO signal and the k-th sub-band signal of the sampling period n, respectively, and $G_{JSGA}(n,k)$ denotes the k-th sub-band gain of the LSG vector obtained from the JSGA module 200 corresponding to the sampling period n (for example, the LSG vector latest obtained with the JSGA module 200 before the sampling period n).

The DAC unit 150 is used to convert the DO signal obtained from the sub-band signal combining unit 1830 into an AO signal of monaural type at the sampling period.

Figure 35:
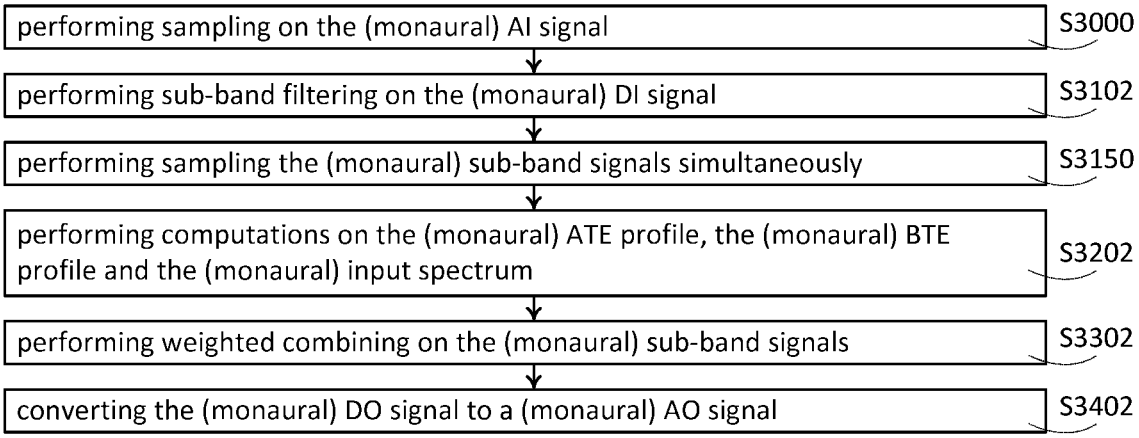
FIG. 35 is a flowchart of a method of implementing the audio processing system of the second embodiment of the present invention.

FIG. 35 is the flowchart of the method of implementing the audio processing system according to the second embodiment of the present invention. In describing flow steps of FIG. 35, the system architecture of FIG. 33 and its corresponding text are referred. Though the flow steps are for continuous-type audio processing, each step is a segment-based operation where a signal segment or spectrum obtained from a preceding step at each time interval can be taken to perform computations immediately, rather than perform computations after the entire signal or all spectra obtained.

In the second embodiment, a DI signal is obtained with the ADC unit 110 by performing sampling on an AI signal at a time period. The AI signal and the DI signal are of monaural type. The time period is called a sampling period (step S3000).

Referring to paragraphs [0137] to [0138], a plurality of sub-band signals of monaural type are obtained with the analysis filter bank 1810 by performing sub-band filtering on the DI signal obtained from the ADC unit 110 (step S3102).

An input spectrum of each time interval is obtained with the sub-band snapshot unit 1820 by performing simultaneous sampling on each sub-band signal obtained from the analysis filter bank 1810 at a time interval and ranking simultaneously sampled values according to their corresponding sub-band center frequencies. The input spectrum and simultaneously sampled values are of monaural type (step S3150).

Referring to flowcharts and descriptions of the JSGA module and its variants of FIG. 8 to FIG. 32, a LSG vector is obtained with the JSGA module 200 by performing computations on an ATE profile, a BTE profile, and the input spectrum of each time interval obtained from the sub-band snapshot unit 1820. The ATE profile, the BTE profile, and the LSG vector are of monaural type (step S3202).

Referring to paragraph [0141], a DO signal of monaural type is obtained with the sub-band signal combining unit 1830 by performing weighted combining on the sub-band signals obtained from the analysis filter bank 1810 according to the LSG vector corresponding to each sampling period (step S3302).

The DO signal obtained from the sub-band signal combining unit 1830 is converted into an AO signal of monaural type at the sampling period with the DAC unit 150 (step S3402).

Moreover, the audio processing system 102 equipped with the filter bank according to the second embodiment has a design flexibility that the time interval of the sub-band snapshot unit 1820 can be dynamically adjusted. Hence it is possible to detect the signal dynamics and lengthen the time interval in a quiet environment or in a slow-varying input condition, to reduce the computations of the JSGA module.

The following illustrates how the JSGA module of the present invention is applied to binaural systems. Similar to cases of monaural systems of previous embodiments, the JSGA module can be applied to binaural systems employing the AMS framework and binaural systems employing filter banks.

Figure 36:
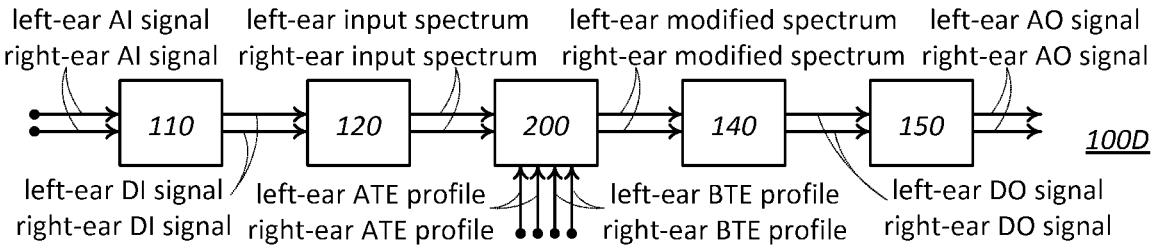
FIG. 36 is a block diagram of an audio processing system according to a third embodiment of the present invention.

FIG. 36 is the block diagram of the audio processing system according to the third embodiment of the present invention, wherein the audio processing system 100D comprises an ADC unit 110, a FWA unit 120, a JSGA module 200, a waveform synthesis unit 140, and a DAC unit 150.

The ADC unit 110 is used to obtain a DI signal by performing sampling on an AI signal at a time period. The AI signal and the DI signal are of binaural type. The time period is referred to as the sampling period.

Referring to paragraphs [0021] to [0022], the FWA unit 120 is used obtain to an input spectrum of each frame period by performing framing and waveform analysis on the left-ear DI signal and the right-ear DI signal of the DI signal obtained from the ADC unit 110, wherein the input spectrum of each frame period is of binaural type.

Referring to block diagrams and descriptions of the JSGA module and its variants of FIG. 5 to FIG. 31, in a binaural system or application, the JSGA module 200 is used to obtain a modified spectrum by performing computations on an ATE profile, a BTE profile, and the input spectrum of each frame period obtained from the FWA unit 120. The ATE profile, the BTE profile, and the modified spectrum are of binaural type.

Referring to paragraph [0024], the waveform synthesis unit 140 is used to obtain a DO signal of binaural type by performing waveform synthesis on the left-ear modified spectrum and the right-ear modified spectrum of the modified spectrum obtained from the JSGA module 200.

The DAC unit 150 is used to convert the DO signal obtained from the waveform synthesis unit 140 into an AO signal of binaural type at the sampling period.

Figure 37:
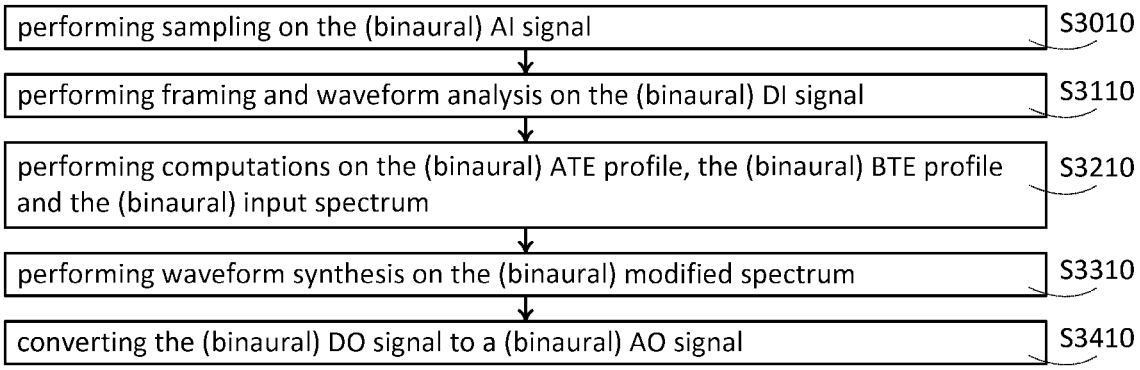
FIG. 37 is a flowchart of a method of implementing the audio processing system according to the third embodiment of the present invention.

FIG. 37 is the flowchart of the method of implementing the audio processing system according to the third embodiment of the present invention. In describing flow steps of FIG. 37, the system architecture of FIG. 36 and its corresponding text are referred. Though the flow steps are for continuous-type audio processing, each step is a segment-based operation where a signal segment or spectrum obtained from a preceding step at each time interval can be taken to perform computations immediately, rather than perform computations after the entire signal or all spectra obtained.

In the third embodiment, a DI signal is obtained with the ADC unit 110 by performing sampling on an AI signal at a time period. The AI signal and the DI signal are of binaural type. The time period is called a sampling period (step S3010).

Referring to paragraphs [0021] to [0022] and [0154], an input spectrum of each frame period is obtained with the FWA unit 120 by performing framing and waveform analysis on the DI signal obtained from the ADC unit 110, wherein the input spectrum of each frame period is of binaural type (step S3110).

Referring to flowcharts and descriptions of the JSGA module and its variants of FIG. 8 to FIG. 32, in a binaural system or application, a modified spectrum is obtained with the JSGA module 200 by performing computations on an ATE profile, a BTE profile, and the input spectrum of each frame period obtained from the FWA unit 120. The ATE profile, the BTE profile, and the modified spectrum are of binaural type (step S3210).

Referring to paragraphs [0024] and [0156], a DO signal of binaural type is obtained with the waveform synthesis unit 140 by performing waveform synthesis on the modified spectrum obtained from the JSGA module 200 (step S3310).

The DO signal obtained from the waveform synthesis unit 140 is converted into an AO signal of binaural type at the sampling period with the DAC unit 150 (step S3410).

Figure 38:
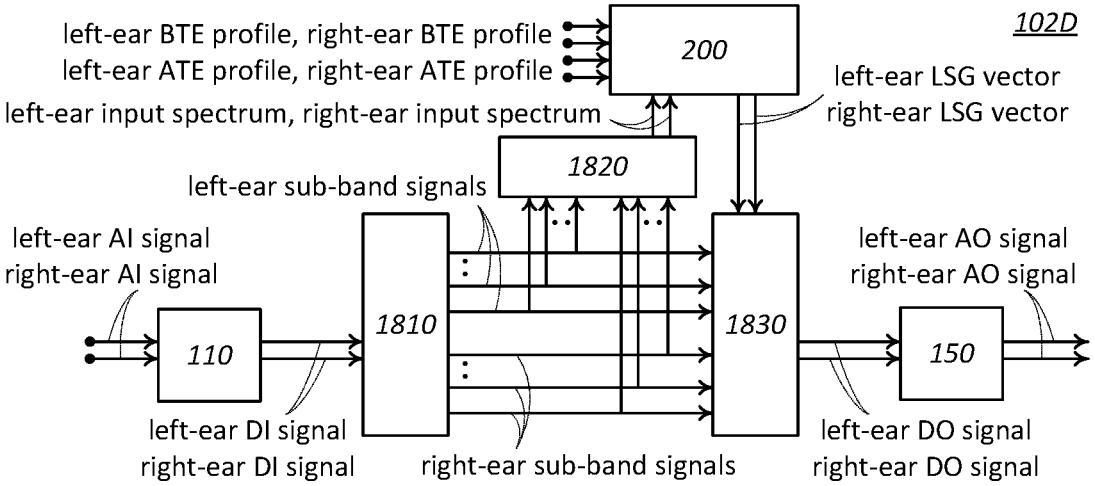
FIG. 38 is a block diagram of an audio processing system according to a fourth embodiment of the present invention.

FIG. 38 is the block diagram of the audio processing system according to the fourth embodiment of the present invention, wherein the audio processing system 102D comprises an ADC unit 110, an analysis filter bank 1810, a sub-band snapshot unit 1820, a JSGA module 200, a sub-band signal combining unit 1830, and a DAC unit 150.

The ADC unit 110 is used to obtain a DI signal by performing sampling on an AI signal at a time period. The AI signal and the DI signal are of binaural type. The time period is referred to as the sampling period.

Referring to paragraphs [0137] and [0138], the analysis filter bank 1810 is used to obtain a plurality of sub-band signals of binaural type by performing sub-band filtering on the left-ear DI signal digital and the right-ear DI signal of the DI signal obtained from the analog-to-digital conversion unit 110 separately.

The sub-band snapshot unit 1820 is used to obtain an input spectrum of each time interval by performing simultaneous sampling on each sub-band signal obtained from the analysis filter bank 1810 at a time interval and ranking simultaneously sampled values according to their corresponding sub-band center frequencies. The input spectrum of each time interval and the simultaneously sampled values are of binaural type.

Referring to block diagrams and descriptions of the JSGA module and its variants of FIG. 5 to FIG. 31, in a binaural system or application, the JSGA module 200 is used to obtain a LSG vector by performing computations on an ATE profile, a BTE profile, and the input spectrum of each time interval obtained from the sub-band snapshot unit 1820. The ATE profile, the BTE profile, and the LSG vector are of binaural type.

Referring to paragraph [0141], the sub-band signal combining unit 1830 is used to obtain a DO signal of binaural type by performing weighted combining on the left-ear sub-band signals and the right-ear sub-band signals of the sub-band signals obtained from the analysis filter bank 1810 according to the left-ear LSG vector and the right-ear LSG vector of the LSG vector corresponding to each sampling period, respectively.

The DAC unit 150 is used to convert the DO signal obtained from the sub-band signal combining unit 1830 into an AO signal of binaural type at the sampling period.

Figure 39:
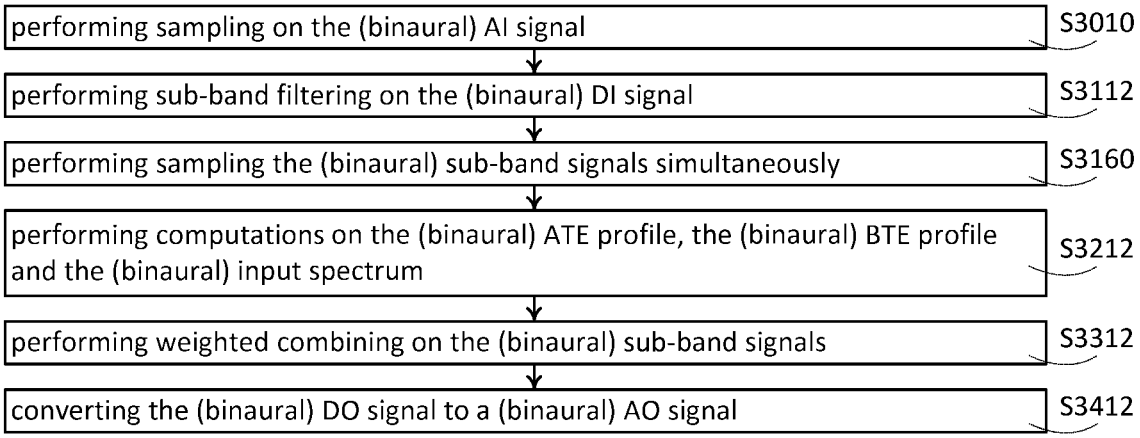
FIG. 39 is a flowchart of a method of implementing the audio processing system according to the fourth embodiment of the present invention.

FIG. 39 is the flowchart of the method of implementing the audio processing system according to the fourth embodiment of the present invention. In describing flow steps of FIG. 39, the system architecture of FIG. 38 and its corresponding text are referred. Though the flow steps are for continuous-type audio processing, each step is a segment-based operation where a signal segment or spectrum obtained from a preceding step at each time interval can be taken to perform computations immediately, rather than perform computations after the entire signal or all spectra obtained.

In the fourth embodiment, a DI signal is obtained with the ADC unit 110 by performing sampling on an AI signal at a time period. The AI signal and the DI signal are of binaural type. The time period is called a sampling period (step S3010).

Referring to paragraphs [0137] to [0138] and [0166], a plurality of sub-band signals of binaural type are obtained with the analysis filter bank 1810 by performing sub-band filtering on the DI signal obtained from the ADC unit 110 (step S3112).

Referring to paragraph [0167], an input spectrum of each time interval is obtained with the sub-band snapshot unit 1820 by performing simultaneous sampling on each sub-band signal obtained from the analysis filter bank 1810 at a time interval and ranking simultaneously sampled values according to their corresponding sub-band center frequencies. The input spectrum of each time interval and the simultaneously sampled values are of binaural type (step S3160).

Referring to flowcharts and descriptions of the JSGA module and its variants of FIG. 8 to FIG. 32, in a binaural system or application, a LSG vector is obtained with the JSGA module 200 by performing computations on an ATE profile, a BTE profile, and the input spectrum of each time interval obtained from the sub-band snapshot unit 1820. The ATE profile, the BTE profile, and the LSG vector are of binaural type (step S3212).

Referring to paragraphs [0141] and [0169], a DO signal of binaural type is obtained with the sub-band signal combining unit 1830 by performing weighted combining on the sub-band signals obtained from the analysis filter bank 1810 according to the LSG vector corresponding to each sampling period (step S3312).

The DO signal obtained from the sub-band signal combining unit 1830 is converted into an AO signal of binaural type at the sampling period with the DAC unit 150 (step S3412).

Although the present invention has been described above with reference to the preferred embodiments and the accompanying drawings, it shall not be considered as limited. Those skilled in the art can make various modifications, omissions and changes to the details of the embodiments of the present invention without departing from the scope of the claims of the invention.

LIST OF REFERENCE NUMBERS

100, 100D, 102, 102D audio processing system
110 analog-to-digital conversion (ADC) unit
120 framing and waveform analysis (FWA) unit
130 spectrum modification module
140 waveform synthesis unit
150 digital-to-analog conversion (DAC) unit
160 noise reduction (NR) module
170 spectrum contrast enhancement (SCE) module
180 dynamic range compression (DRC) module
190, 210 fitting procedure
200 joint spectral gain adaptation (JSGA) module
230 aided-ear loudness (AL) model
240 bare-ear loudness (BL) model
250 spectrum shaping (SS) sub-module
320 specific loudness estimation sub-module
340 hearing loss model
350 temporal integration sub-module
360 spectrum-to-excitation pattern conversion sub-module
510 error measurement sub-module
520 gain adjustment sub-module
540 format conversion sub-module
550 spectrum scaling sub-module
800 loudness spectrum compression sub-module
810 channel loudness calculation sub-module
820 compression characteristic substitution sub-module
830 loudness spectrum scaling sub-module
1100 attack trimming (AT) sub-module
1110 total loudness calculation sub-module
1120 loudness upper-bound estimation sub-module
1130 loudness limiting sub-module
1300 noise reduction (NR) sub-module
1310 noise estimation sub-module
1320 signal estimation sub-module
1330 signal quality estimation sub-module
1810 analysis filter bank
1820 sub-band snapshot unit
1830 sub-band signal combining unit

What is claimed is:

1. A joint spectral gain adaptation (JSGA) apparatus, comprising:

an aided-ear loudness processor (AL processor), which is located in the JSGA apparatus and is configured to receive and perform computations on an aided-ear threshold elevation profile (ATE profile) and a spectrum selected from the group consisting of an input spectrum and a first spectrum derived from the input spectrum to obtain an aided-ear loudness spectrum (AL spectrum);

a bare-ear loudness processor (BL processor), which is located in the JSGA apparatus and is configured to receive and perform computations on a bare-ear threshold elevation profile (BTE profile) and a modified spectrum previously obtained to obtain a bare-ear loudness spectrum (BL spectrum); and a spectrum shaping processor (SS processor), which is located in the JSGA apparatus and connected to the bare-ear loudness processor, the spectrum shaping processor is configured to receive and perform computations on the input spectrum, the BL spectrum, and a loudness spectrum selected from the group consisting of the AL spectrum and a first loudness spectrum derived from the AL spectrum to obtain a modified spectrum and a linear spectral gain vector (LSG vector);

wherein the modified spectrum previously obtained is passed to the BL processor as an input.

2. The JSGA apparatus according to claim 1, wherein the ATE profile is determined according to the BTE profile.

3. The JSGA apparatus according to claim 1, further comprising a loudness spectrum compression processor, which is located in the JSGA apparatus, the loudness spectrum compression processor is configured to receive and perform dynamic range compression processing on a loudness spectrum selected from the group consisting of the AL spectrum and a second loudness spectrum derived from the AL spectrum to obtain a compressed loudness spectrum (CL spectrum), wherein the first loudness spectrum derived from the AL spectrum is the CL spectrum or a first loudness spectrum derived from the CL spectrum.

4. The JSGA apparatus according to claim 3, further comprising an attack trimming processor, which is located in the JSGA apparatus and connect to the loudness spectrum compression processor and the AL processor respectively, the attack trimming processor is configured to receive and perform attack trimming processing on a loudness spectrum selected from the group consisting of the CL spectrum and a second loudness spectrum derived from the CL spectrum to obtain a trimmed loudness spectrum (TL spectrum), wherein the first loudness spectrum derived from the CL spectrum is the TL spectrum or a loudness spectrum derived from the TL spectrum.

5. The JSGA apparatus according to claim 1, further comprising a noise reduction processor, which is located in the JSGA apparatus and connect to the AL processor, the noise reduction processor is configured to receive and perform noise reduction processing on a spectrum selected from the group consisting of the input spectrum and a second spectrum derived from the input spectrum to obtain a signal quality vector and a noise reduction spectrum (NR spectrum), wherein the signal quality vector can pass to the SS processor as an input, wherein the first spectrum derived from the input spectrum is the NR spectrum or a spectrum derived from the NR spectrum.

6. The JSGA apparatus according to claim 1, further comprising a noise reduction processor, which is located in the JSGA apparatus and connect to the AL processor and the SS processor respectively, the noise reduction processor is configured to receive and perform noise reduction processing on a loudness spectrum selected from the group consisting of the AL spectrum and a second loudness spectrum derived from the AL spectrum to obtain a signal quality vector and a noise reduction loudness spectrum (NRL spectrum), wherein the signal quality vector can pass to the SS processor as an input, wherein the first loudness spectrum derived from the AL spectrum is the NRL spectrum or a loudness spectrum derived from the NRL spectrum.

7. The JSGA apparatus according to claim 4, further comprising a noise reduction processor, which is located in the JSGA apparatus and connect to the AL processor, the noise reduction processor is configured to receive and perform noise reduction processing on a spectrum selected from the group consisting of the input spectrum and a second spectrum derived from the input spectrum to obtain a signal quality vector and a noise reduction spectrum (NR spectrum), wherein the signal quality vector can pass to the SS processor as an input, wherein the first spectrum derived from the input spectrum is the NR spectrum or a spectrum derived from the NR spectrum.

8. The JSGA apparatus according to claim 4, further comprising a noise reduction processor, which is located in the JSGA apparatus and connect to the AL processor and the SS processor respectively, the noise reduction processor is configured to receive and perform noise reduction processing on a loudness spectrum selected from the group consisting of the AL spectrum and a third loudness spectrum derived from the AL spectrum to obtain a signal quality vector and a noise reduction loudness spectrum (NRL spectrum) wherein the signal quality vector can pass to the SS processor as an input, wherein the second loudness spectrum derived from the AL spectrum is the NRL spectrum or a loudness spectrum derived from the NRL spectrum.

9. An audio processing system comprising a joint spectral gain adaptation (JSGA) apparatus according to claim 1, wherein a modified spectrum is obtained by performing computations on an ATE profile, a BTE profile, and an input spectrum of each frame period, the audio processing system further comprising:

an analog-to-digital conversion unit, wherein a digital input signal is obtained by performing sampling on an analog input signal at a sampling period;

a framing and waveform analysis unit, wherein the input spectrum of each frame period is obtained by performing framing and waveform analysis on the digital input signal;

a waveform synthesis unit and a digital output signal obtained by performing waveform synthesis on the modified spectrum; and a digital-to-analog conversion unit, wherein the digital output signal is converted into an analog output signal at the sampling period.

10. An audio processing system comprising a joint spectral gain adaptation (JSGA) apparatus according to claim 1, wherein a LSG vector is obtained by performing computations on an ATE profile, a BTE profile, and an input spectrum of each time interval, the audio processing system further comprising:

an analog-to-digital conversion unit, wherein a digital input signal is obtained by performing sampling on an analog input signal at a sampling period;

an analysis filter bank and a plurality of sub-band signals obtained by performing sub-band filtering on the digital input signal;

a sub-band snapshot unit, wherein the input spectrum of each time interval is obtained by performing simultaneous sampling on each sub-band signal at a time interval and ranking the simultaneously sampled values according to their corresponding sub-band center frequencies;

a sub-band signal combining unit and a digital output signal obtained by performing weighted combining on the sub-band signals according to the LSG vector corresponding to each sampling period; and a digital-to-analog conversion unit, wherein the digital output signal is converted into an analog output signal at the sampling period.

11. A joint spectral gain adaptation (JSGA) method applied to a JSGA apparatus comprising an aided-ear loudness processor (AL processor), a bare-ear loudness processor (BL processor), and a spectrum shaping processor (SS processor), the JSGA method comprising the following steps:

obtaining an aided-ear loudness spectrum (AL spectrum) with the AL processor by performing computations on an aided-ear threshold elevation profile (ATE profile) and a spectrum selected from the group consisting of an input spectrum and a first spectrum derived from the input spectrum;

passing a modified spectrum previously obtained from the SS processor to the BL processor as an input, and obtaining a bare-ear loudness spectrum (BL spectrum) with the BL processor by performing computations on a bare-ear threshold elevation profile (BTE profile) and a modified spectrum previously obtained; and obtaining a modified spectrum and a linear spectral gain vector (LSG vector) with the SS processor by performing computations on the input spectrum, the BL spectrum, and a loudness spectrum selected from the group consisting of the AL spectrum and a first loudness spectrum derived from the AL spectrum.

12. The JSGA method according to claim 11, wherein the ATE profile is determined according to the BTE profile.

13. The JSGA method according to claim 11, wherein the JSGA apparatus further comprises a loudness spectrum compression processor, the JSGA method further comprising a step of obtaining a compressed loudness spectrum (CL spectrum) with the loudness spectrum compression processor by performing dynamic range compression processing on a loudness spectrum selected from the group consisting of the AL spectrum and a second loudness spectrum derived from the AL spectrum, wherein the first loudness spectrum derived from the AL spectrum is the CL spectrum or a first loudness spectrum derived from the CL spectrum.

14. The JSGA method according to claim 13, wherein the JSGA apparatus further comprises an attack trimming processor, the JSGA method further comprising a step of obtaining a trimmed loudness spectrum (TL spectrum) with the attack trimming processor by performing attack trimming processing on a loudness spectrum selected from the group consisting of the CL spectrum and a second loudness spectrum derived from the CL spectrum, wherein the first loudness spectrum derived from the CL spectrum is the TL spectrum or a loudness spectrum derived from the TL spectrum.

15. The JSGA method according to claim 11, wherein the JSGA apparatus further comprises a noise reduction processor, the JSGA method further comprising a step of obtaining a signal quality vector and a noise reduction spectrum (NR spectrum) with the noise reduction processor by performing noise reduction processing on a spectrum selected from the group consisting of the input spectrum and a second spectrum derived from the input spectrum, wherein the signal quality vector can pass to the SS processor as an input, wherein the first spectrum derived from the input spectrum is the NR spectrum or a spectrum derived from the NR spectrum.

16. The JSGA method according to claim 11, wherein the JSGA apparatus further comprises a noise reduction processor, the JSGA method further comprising a step of obtaining a signal quality vector and a noise reduction loudness spectrum (NRL spectrum) with the noise reduction processor by performing noise reduction processing on a loudness spectrum selected from the group consisting of the AL spectrum and a second loudness spectrum derived from the AL spectrum, wherein the signal quality vector can pass to the SS processor as an input, wherein the first loudness spectrum derived from the AL spectrum is the NRL spectrum or a loudness spectrum derived from the NRL spectrum.

17. The JSGA method according to claim 14, wherein the JSGA apparatus further comprises a noise reduction processor, the JSGA method further comprising a step of obtaining a signal quality vector and a noise reduction spectrum (NR spectrum) with the noise reduction processor by performing noise reduction processing on a spectrum selected from the group consisting of the input spectrum and a second spectrum derived from the input spectrum, wherein the signal quality vector can pass to the SS processor as an input, wherein the first spectrum derived from the input spectrum is the NR spectrum or a spectrum derived from the NR spectrum.

18. The JSGA method according to claim 11, wherein the JSGA apparatus further comprises a noise reduction processor, the JSGA method further comprising a step of obtaining a signal quality vector and a noise reduction loudness spectrum (NRL spectrum) with the noise reduction processor by performing noise reduction processing on a loudness spectrum selected from the group consisting of the AL spectrum and a third loudness spectrum derived from the AL spectrum, wherein the signal quality vector can pass to the SS processor as an input, wherein the second loudness spectrum derived from the AL spectrum is the NRL spectrum or a loudness spectrum derived from the NRL spectrum.

19. A method of implementing an audio processing system comprising a step of implementing a joint spectral gain adaptation (JSGA) method with a JSGA apparatus according to claim 11 by performing computations on an ATE profile, a BTE profile, and an input spectrum of each frame period to obtain a modified spectrum, the method of implementing the audio processing system further comprising the following steps:

performing sampling on an analog input signal at a sampling period with an analog-to-digital conversion unit to obtain a digital input signal;

performing framing and waveform analysis on the digital input signal with a framing and waveform analysis unit to obtain the input spectrum of each frame period;

performing waveform synthesis on the modified spectrum with a waveform synthesis unit to obtain a digital output signal; and converting the digital output signal into an analog output signal at the sampling period with a digital-to-analog conversion unit.

20. A method of implementing an audio processing system comprising a step of implementing a joint spectral gain adaptation (JSGA) method with a JSGA apparatus according to claim 11 by performing computations on an ATE profile, a BTE profile, and an input spectrum of each time interval to obtain a LSG vector, the method of implementing the audio processing system further comprising the following steps:

performing sampling on an analog input signal at a sampling period with an analog-to-digital conversion unit to obtain a digital input signal;

performing sub-band filtering on the digital input signal with an analysis filter bank to obtain a plurality of sub-band signals;

performing simultaneous sampling on each of the plurality of sub-band signals at a time interval and ranking the simultaneously sampled values according to their corresponding sub-band center frequencies with a sub-band snapshot unit to obtain the input spectrum of each time interval;

performing weighted combining on the plurality of sub-band signals according to the LSG vector corresponding to each sampling period with a sub-band signal combining unit to obtain a digital output signal; and converting the digital output signal into an analog output signal at the sampling period with a digital-to-analog conversion unit.

* * * * *